US007473508B2

(12) United States Patent
Higuchi et al.

(10) Patent No.: US 7,473,508 B2
(45) Date of Patent: Jan. 6, 2009

(54) TONER, DEVELOPER AND IMAGE FORMING APPARATUS

(75) Inventors: Hiroto Higuchi, Numazu (JP); Fumihiro Sasaki, Fuji (JP); Shinichiro Yagi, Numazu (JP); Shigeru Emoto, Numazu (JP); Junichi Awamura, Suntou-gun (JP); Naohito Shimota, Suntou-gun (JP); Masami Tomita, Numazu (JP); Toshiki Nanya, Mishima (JP); Takahiro Honda, Suntou-gun (JP); Maiko Kondo, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 470 days.

(21) Appl. No.: 10/793,320

(22) Filed: Mar. 5, 2004

(65) Prior Publication Data

US 2004/0229147 A1 Nov. 18, 2004

(30) Foreign Application Priority Data

Mar. 7, 2003 (JP) ..... 2003-062530
Mar. 7, 2003 (JP) ..... 2003-062581
May 26, 2003 (JP) ..... 2003-147202

(51) Int. Cl.
*G03G 9/08* (2006.01)

(52) U.S. Cl. ..... 430/110.3; 430/110.1; 430/110.4; 399/119; 399/252

(58) Field of Classification Search ..... 430/110.3, 430/110.4, 110.1, 109.4, 137.1, 137.19, 123.5; 399/119, 252
See application file for complete search history.

(56) References Cited

U.S. PATENT DOCUMENTS 5,430,526 A * 7/1995 Ohkubo et al. ..... 399/159
5,745,833 A * 4/1998 Abe et al. ..... 399/330
6,096,468 A * 8/2000 Ohno et al. ..... 430/108.3
6,660,443 B2 12/2003 Sugiyama et al. ..... 430/108.4
6,667,141 B2 12/2003 Iwamoto et al. ..... 430/111.4
6,740,460 B2 5/2004 Tomita et al.
6,756,175 B2 6/2004 Emoto et al.
6,770,411 B2 8/2004 Masuda et al.
6,787,280 B2 9/2004 Yamashita et al.
6,818,370 B2 11/2004 Uchinokura et al.
6,824,945 B2 11/2004 Emoto et al.
6,835,517 B2 12/2004 Kondo et al.
6,846,604 B2 1/2005 Emoto et al.
6,849,369 B2 2/2005 Yagi et al.
6,852,462 B2 2/2005 Emoto et al.
6,856,774 B2 2/2005 Sampe et al.
6,858,365 B2 2/2005 Sawada et al.
6,873,814 B2 3/2005 Ohjimi et al.
6,887,636 B2 5/2005 Matsuda et al.
6,898,406 B2 5/2005 Suzuki et al.
6,902,857 B2 6/2005 Yagi et al.
6,916,587 B2 7/2005 Fushimi et al.
6,924,073 B2 8/2005 Higuchi et al.
6,936,390 B2 8/2005 Nanya et al.
7,005,223 B2 2/2006 Yamashita et al.
7,056,636 B2 * 6/2006 Tomita et al. ..... 430/108.4
7,157,201 B2 1/2007 Tomita et al.
2003/0021618 A1 * 1/2003 Ogara et al. ..... 399/350
2003/0027066 A1 2/2003 Yamashita et al.
2003/0055159 A1 3/2003 Yamashita et al.
2003/0096185 A1 5/2003 Yamashita et al.
2003/0134220 A1 * 7/2003 Emoto et al. ..... 430/109.4
2004/0058260 A1 3/2004 Katoh et al.
2004/0229147 A1 11/2004 Higuchi et al.

FOREIGN PATENT DOCUMENTS

EP 0 869 397 10/1998
EP 0 869 399 10/1998
EP 1296194 A2 * 3/2003
JP 61-279864 12/1986
JP 07-049585 2/1995
JP 09-179411 11/1997
JP 10-232507 9/1998
JP 11-052618 2/1999
JP 11-133665 5/1999
JP 11-149180 6/1999
JP 2000-10331 1/2000
JP 2000-029297 1/2000
JP 2000-267331 9/2000

(Continued)

OTHER PUBLICATIONS

Diamond, A.S., ed., Handbook of Imaging Materials, Marcel Dekker, NY (1991), pp. 160-161.*
U.S. Appl. No. 11/100,813, filed Apr. 7, 2005, Ojimi et al.
U.S. Appl. No. 11/289,488, filed Nov. 30, 2005, Shimojo et al.
U.S. Appl. No. 11/513,175, filed Aug. 31, 2006, Ohki et al.
U.S. Appl. No. 11/512,385, filed Aug. 30, 2006, Tomita.
U.S. Appl. No. 11/519,893, filed Sep. 13, 2006, Inoue et al.

(Continued)

*Primary Examiner*—Janis L Dote
(74) *Attorney, Agent, or Firm*—Oblon, Spivak, McClelland, Maier & Neustadt, P.C.

(57) ABSTRACT

A toner composition including toner particles including at least a binder resin; and a colorant, wherein the toner composition satisfies at least one of the following relationships (1) and (2):

$$B \leqq 14 \text{ when } 155 < A \leqq 180; \text{ and}$$

$$B \leqq 0.6A - 79 \text{ when } 145 \leqq A \leqq 155, \quad (1)$$

wherein A represents a shape factor SF-1 of the toner composition and B represents a content of toner particles having a particle diameter not greater than 3 μm; and $$B \leqq 14 \text{ when } 0.920 \leqq A' \leqq 0.950; \text{ and}$$

$$B \leqq 394 - 400A' \text{ when } 0.950 < A' \leqq 0.965 \quad (2)$$

wherein A' represents an average circularity of the toner composition and B represents a content of toner particles having a particle diameter not greater than 3 μm.

12 Claims, 8 Drawing Sheets

FOREIGN PATENT DOCUMENTS

| | | |
|---|---|---|
| JP | 2000-292981 | 10/2000 |
| JP | 2001-13732 | 1/2001 |
| JP | 2001-66811 | 3/2001 |
| JP | 2001-75311 | 3/2001 |
| JP | 2002-023408 | 1/2002 |
| JP | 2002-091083 | 3/2002 |
| JP | 2002-108022 | 4/2002 |
| JP | 2002-214823 | 7/2002 |
| JP | 2002-287400 | 10/2002 |
| JP | 2002-323780 | 11/2002 |
| JP | 2002-341567 | 11/2002 |
| WO | WO 02/056166 | 7/2002 |

OTHER PUBLICATIONS

U.S. Appl. No. 11/529,370, filed Sep. 29, 2006, Emoto et al.
U.S. Appl. No. 11/608,521, filed Dec. 8, 2006, Satoru et al.
U.S. Appl. No. 11/007,784, filed Dec. 9, 2004, Kondo et al.
U.S. Appl. No. 11/030,307, filed Jan. 7, 2005, Kami et al.
U.S. Appl. No. 11/016,708, filed Dec. 21, 2004, Kitajima et al.
U.S. Appl. No. 11/687,372, filed Mar. 16, 2007, Yamada et al.
U.S. Appl. No. 11/685,872, filed Mar. 14, 2007, Uchinokura et al.
U.S. Appl. No. 11/685,969, filed Mar. 14, 2007, Uchinokura et al.
U.S. Appl. No. 11/734,895, filed Apr. 13, 2007, Yamashita et al.
U.S. Appl. No. 11/853,490, filed Sep. 11, 2007, Miyamoto et al.
U.S. Appl. No. 11/855,806, filed Sep. 14, 2007, Awamura et al.
U.S. Appl. No. 11/856,379, filed Sep. 17, 2007, Sawada et al.
U.S. Appl. No. 12/013,108, filed Jan. 11, 2008, Yagi et al.
U.S. Appl. No. 12/050,502, filed Mar. 18, 2008, Yamada et al.
U.S. Appl. No. 12/040,451, filed Feb. 29, 2008, Saitoh et al.
U.S. Appl. No. 12/047,807, filed Mar. 13, 2008, Honda et al.

* cited by examiner

TONER, DEVELOPER AND IMAGE FORMING APPARATUS

BACKGROUND OF THE INVENTION

1. Field of the Invention

The present invention relates to a toner for use in a developer developing an electrostatic latent image in electrophotography, electrostatic recording and electrostatic printing, and to an electrophotographic image forming apparatus using the toner.

2. Discussion of the Background

Typically, in an electrophotographic or an electrostatic recording image forming apparatus such as copiers, printers and facsimiles, an electrostatic latent image based on an image information is formed on a latent image bearer such as photoreceptor drums and photoreceptor belts; an image developer forms a toner image by transferring a toner onto the latent image bearer; and the toner image is transferred onto a recording medium to form an image. In such a system, a residual toner on a surface of the photoreceptor needs to sufficiently be removed after a toner image is transferred because the surface thereof is repeatedly used to form the toner images. Several methods of removing the residual toner have conventionally been studied, and a method of scraping the residual toner by contacting a cleaning blade to the surface of the photoreceptor is widely in practical use because of being low-cost and capable of downsizing the whole system.

The toner removal efficiency of the above-mentioned method largely depends on a contact pressure between the photoreceptor and cleaning blade, and on a surface profile of the photoreceptor or a developing sleeve. Similarly, in terms of toner properties, the toner removal efficiency largely depends on the shape of a toner and surface profile thereof. When the toner removal is insufficient, the residual toner filming over a surface of the photoreceptor drum occurs. Further, the accumulated filming increases a stress between the photoreceptor and cleaning blade, resulting in occurrence of the toner fusion bond due to a heat generation and a fatigue abrasion of the photoreceptor. The more accelerated such problems, the smaller the particle diameter of the toner. The surface of the photoreceptor is not sufficiently cleaned because an adherence of such a toner to the photoreceptor increases and an amount of the toner scraping through a gap between the photoreceptor and cleaning blade increases.

To solve these problems, Japanese Laid-Open Patent Publication No. 2000-267331 discloses an image forming method wherein a toner has a shape factor, i.e., SF-1 of from 125 to 130, and a particle diameter of the toner and a content thereof having such a shape factor are specified; Japanese Laid-Open Patent Publication No. 2000-023408 discloses a blade brush cleaning method wherein a toner having a SF-1 of from 100 to 160 is 65% by number; Japanese Laid-Open Patent Publication No. 2000-029297 discloses a method of using a magnetic carrier having a SF-1 of from 100 to 140, a SF-2 of from 100 to 120 and a specific resistance of from $1\times10^{10}$ Ω·cm to $1\times10^{14}$ Ω·cm; Japanese Laid-Open Patent Publication No. 09-179411 discloses a method wherein a developing sleeve and a photoreceptor drive in the same direction at a peripheral speed ratio of from 0.5 to 1.8, and the toner has a SF-1 of from 135 to 150 and a SF-2 of from 115 to 125; and; Japanese Laid-Open Patent Publication No. 7-49585 discloses a toner having a spheric shape and an amorphous shape at a constant rate. All of these specify the shape factor of the toner to mainly improve cleanability and transferability thereof, and are not limited to an improvement of the cleanability.

However, only with such a specification of the shape factor of the toner, the surface of the photoreceptor is not occasionally cleaned well depending on the conditions of the method. Particularly, such problems occur when the toner has a smaller particle diameter or a smooth surface with less concavities and convexities, and when a contact pressure between the surface of the photoreceptor and cleaning blade in an image forming apparatus is low. The toner having a small particle diameter has a higher adherence to the photoreceptor and tends to remain thereon even after development, and therefore the cleaning members are easily consumed. Further, the residual toner contaminates a charging roller charging the photoreceptor while contacting thereto and impairs the charging capability of the charging roller. On the contrary, a toner having a large particle diameter has a good cleanability but has a poor transferability, resulting in deterioration of image resolution.

On the other hand, it is known that the cleanability of the toner largely depends on the surface nature thereof, which is largely influenced by a toner production method such as pulverization methods and polymerization methods.

A toner produced by a conventional kneading and pulverizing method has an advantage in the cleanability because of being amorphous, but it is not easy to control a shape and a surface structure of the toner. Further, it is difficult to narrow a particle diameter distribution of the toner and to make the toner have an average particle diameter not greater than 6 μm in terms of classifying capability, yield, productivity and cost. Japanese Laid-Open Patent Publication No. 11-133665 discloses a dry toner using an elongated urethane-modified polyester as a binder and having a practical sphericity of from 0.90 to 1.00. The fixability, transferability and fluidity of the toner are improved, but the cleanability thereof is lower than that of the pulverized amorphous toner.

Japanese Laid-Open Patent Publications Nos. 11-149180 and 2000-292981 disclose a spheric dry toner having a small particle diameter and an economical method of producing the toner, which has good powder fluidity, transferability, thermostable preservability, low-temperature fixability, hot offset resistance, and which produces images having good glossiness particularly when used in a full-color copier and does not need an oil application to a heat roller, wherein the dry toner includes a toner binder formed from an elongation and/or a suspension reaction of a prepolymer including an isocyanate; and a colorant, and wherein the toner is formed from the elongation and/or suspension reaction between the prepolymer and amines in an aqueous medium. However, the spheric toner does not have both good cleanability particularly with a blade cleaner and transferability yet.

The toner disclosed in Japanese Laid-Open Patent Publications Nos. 11-149180 and 2000-292981 is produced by the above-mentioned polymerization method to have a particle diameter distribution with less unevenness and a stable chargeability. The toner produced thereby has a high lubricity because of having almost uniformly less concavity and convexity and a higher sphericity than the pulverized toner. Therefore, the toner tends to scrape through a contact portion between the photoreceptor and cleaning blade and has worse cleanability than the pulverized toner. Further, the toner typically tends to have a strong adherence to the surface of a photoreceptor, and therefore has poor cleanability and produces defective images.

Because of these reasons, a need exists for a toner for developing an electrostatic latent image, which has sufficient cleanability after development and produces high-quality images.

SUMMARY OF THE INVENTION

Accordingly, an object of the present invention is to provide a toner for developing an electrostatic latent image, which has sufficient cleanability after development and produces high-quality images, and an image forming apparatus using the toner.

Another object of the present invention is to provide a toner container containing the toner, a developer including the toner, an image forming method using the developer and an image forming apparatus using the developer.

Briefly these objects and other objects of the present invention as hereinafter will become more readily apparent can be attained by a toner composition including toner particles including at least a binder resin; and a colorant, wherein the toner composition satisfies at least one of the following relationships (1) and (2):

$$B \leqq 14 \text{ when } 155 < A \leqq 180; \text{ and}$$

$$B \leqq 0.6A - 79 \text{ when } 145 \leqq A \leqq 155, \quad (1)$$

wherein A represents a shape factor SF-1 of the toner composition and B represents a content of toner particles having a particle diameter not greater than 3 μm; and $$B \leqq 14 \text{ when } 0.920 \leqq A' \leqq 0.950; \text{ and}$$

$$B \leqq 394 - 400A' \text{ when } 0.950 < A' \leqq 0.965 \quad (2)$$

wherein A' represents an average circularity of the toner composition and B represents a content of toner particles having a particle diameter not greater than 3 μm.

Further, the toner composition preferably has a volume-average particle diameter of from 3.0 to 7.0 μm.

Furthermore, the toner is preferably produced by a method wherein toner constituents including a binder resin including a modified polyester resin are dissolved or dispersed in an organic solvent to prepare a solution or a dispersion; the solution or the dispersion is mixed with a compound having an active hydrogen atom in an aqueous medium including a particulate resin material to react the modified polyester with the compound to prepare a reactant; removing the organic solvent is removed from the reactant to prepare a dispersion including particles; and the particles are washed to remove excessive particles of the particulate resin material from a surface of the partciles.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
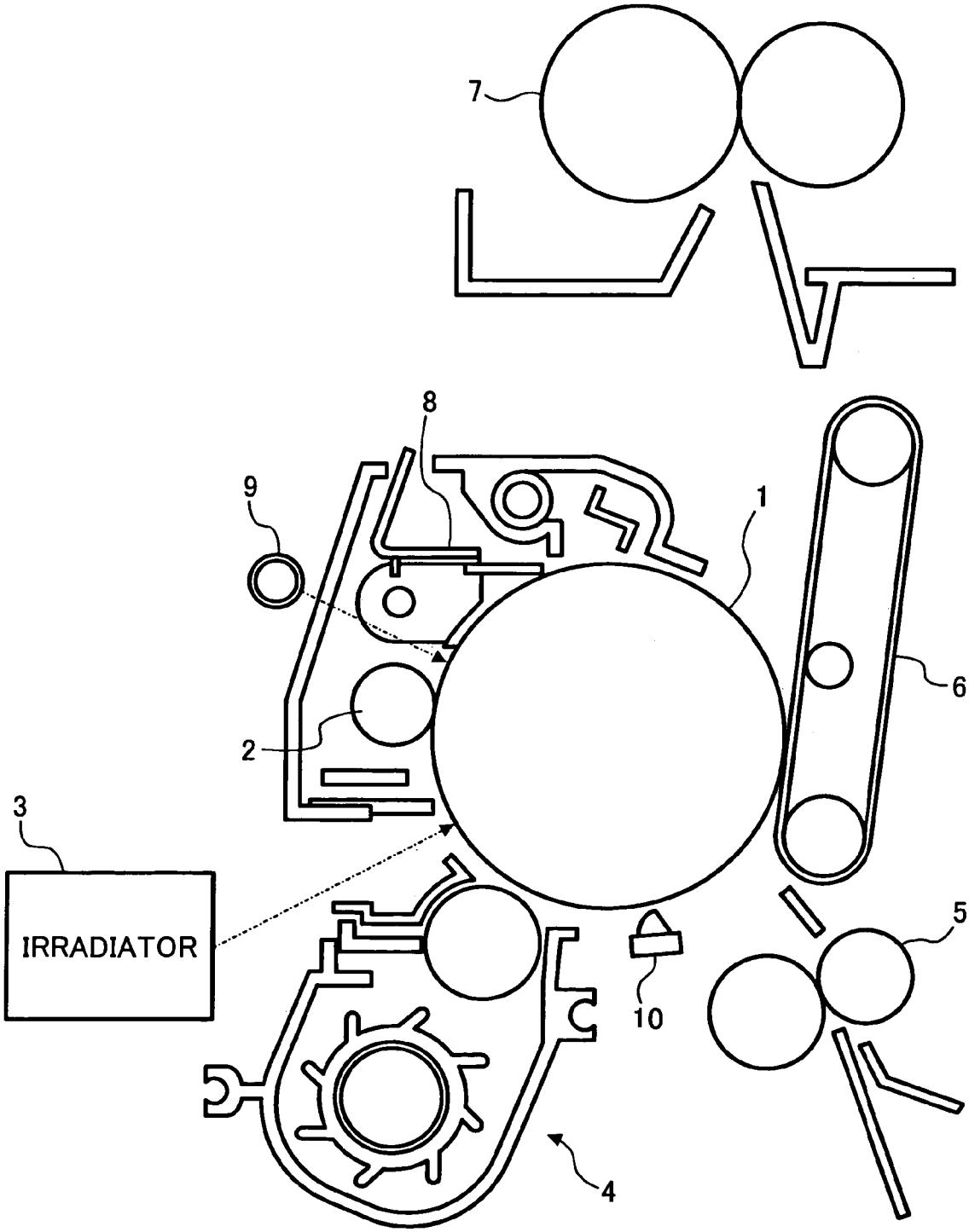
FIG. 1 is a schematic view illustrating an embodiment of an image forming apparatus equipped with the image developer of the present invention.

Generally, the present invention provides a toner composition including toner particles including at least a binder resin; and a colorant, wherein the toner composition satisfies at least one of the following relationships (1) and (2):

$$B \leqq 14 \text{ when } 155 < A \leqq 180; \text{ and}$$

$$B \leqq 0.6A - 79 \text{ when } 145 \leqq A \leqq 155, \quad (1)$$

wherein A represents a shape factor SF-1 of the toner composition and B represents a content of toner particles having a particle diameter not greater than 3 μm; and $$B \leqq 14 \text{ when } 0.920 \leqq A' \leqq 0.950; \text{ and}$$

$$B \leqq 394 - 400A' \text{ when } 0.950 < A' \leqq 0.965 \quad (2)$$

wherein A' represents an average circularity of the toner composition and B represents a content of toner particles having a particle diameter not greater than 3 μm.

The cleanability largely depends on the shape and surface profile of the toner as mentioned above, and on an amount of a fine powder toner easily passing through the cleaning blade as well. On the other hand, a toner having a large particle diameter produces defective images due to defective transfer. The present inventors discovered that it is essential that a toner has the shape factor or average circularity and the content of the fine powder satisfying one the above-mentioned relationships to have good clean ability and prevent the defective images due to defective transfer.

When the shape factor SF-1 is less than 145 (average circularity is greater than 0.965), most of the toner scrapes through a gap between the photoreceptor and cleaning blade because of the spheric shape, resulting in poor cleaning. When the SF-1 is greater than 155 (average circularity is not greater than 0.950), the fine powder becomes a controlling factor more than the SF-1 (average circularity) for cleaning. Therefore, when a content of the fine powder having a particle diameter not greater than 3 μm is larger than 14% by number, the toner passes through the cleaning blade more and cleanability thereof cannot be maintained for a long time. When the SF-1 is greater than 180 (average circularity is less than 0.920), a transfer ratio of the toner deteriorates and a shape thereof is deformed as time passes and particularly a fine powder rate thereof increases, resulting in noticeable deterioration of image quality. Therefore, it is essential that the SF-1 should be not greater than 180 (average circularity should be not less than 0.920). In addition, it is essential that the content of the fine powder having a particle diameter not greater than 3 μm should satisfy the above-mentioned relationship when the SF-1 is from 145 to 155 (average circularity is from 0.950 to 0.965).

A toner produced by the polymerization method tends to have a smooth surface and a low cleanability, but the toner satisfying the above conditions has sufficient cleanability.

A developer including such a toner and a carrier can prevent the toner spent onto the carrier caused by a fusion bond thereof due to a heat generated by an excessive stress between the photoreceptor and cleaning blade, and therefore can prevent deterioration of chargeability of the developer as time passes.

A image forming apparatus using the toner can prevent deterioration of the cleaning blade, photoreceptor and consequently of image quality.

The toner of the present invention preferably has a volume-average particle diameter of from 3.0 to 7.0 μm in terms of thin-line reproducibility (image quality) and cleanability.

An outline of a COULTER COUNTER and a flow-type particle image analyzer used for measuring the particle in the present invention will be explained. The volume-average particle diameter of the toner is measured by a COULTER COUNTER TA-II® connected with an interface producing a number distribution and a volume distribution from Nikkaki Bios Co., Ltd. and a personal computer PC9801® from NEC Corp. An NaCl aqueous solution including a first class sodium by 1% is used as an electrolyte. The measurement method is as follows:

0.1 to 5 ml of a detergent, preferably alkylbenzene sulfonate is included as a dispersant in 50 to 100 ml of the electrolyte;

1 to 10 mg of a sample toner is included in the electrolyte and the toner is dispersed by an ultrasonic disperser for about for 1 min to prepare a sample dispersion liquid;

the sample dispersion liquid is included in 100 to 200 ml of the electrolyte in another beaker to have a predetermined concentration;

a particle diameter distribution of 30,000 particles having a number-average particle diameter of from 2 to 40 μm is measured by the Coulter Counter TA-II® using an aperture of 100 μm to compute volume and number distribution thereof; and a content of the fine powder having a volume-average particle diameter not greater than 3 μm and volume-average particle diameter of the 30,000 particles are determined.

The shape factor (SF-1) in the present invention is determined by the following formula and shows a sphericity of the toner.

$$SF\text{-}1=(\text{an absolute maximum length of a toner})^2/\text{a projected area of the toner}\times\pi/4\times100$$

The SF-1 shows a sphericity of the toner, and as the SF-1 becomes greater than 100, the toner becomes amorphous from sphericity. The absolute maximum length of a toner represents an absolute maximum length between two parallel lines sandwiching a projected image of the toner on a flat surface. The projected area of the toner represents an area of the projected image of the toner on a flat surface.

The SF-1 can be measured by randomly sampling toner images enlarged 1,000 times as large as the original images, which have about 100 particles (or more) using scanning electron microscope S-2700® from Hitachi, Ltd.; and introducing the image information to an image analyzer Luzex AP® from NIRECO Corp. through an interface to analyze the information. In the present invention, as mentioned above, when the SF-1 I small, the toner easily scrapes through a gap between the photoreceptor and cleaning blade, resulting in poor cleaning. When the SF-1 is greater than 180, the toner has good cleanability, but transferability thereof deteriorates, resulting in defective images such as chipped images.

The average circularity of the toner can be measured by a flow-type particle image analyzer FPIA-2000® from SYSMEX CORPORATION. An outline of the analyzer and measuring method is disclosed in Japanese Laid-Open Patent Publication No. 8-136439. The measurement method is as follows:

0.1 to 5 ml of a detergent, preferably alkylbenzene sulfonate is included as a dispersant in 50 to 100 ml of an NaCl aqueous solution including a first class sodium by 1% after filtered with a mesh having an opening of 0.45 μm;

1 to 10 mg of a sample toner is included in the aqueous solution and the toner is dispersed by an ultrasonic disperser for about for 1 min to prepare a sample dispersion liquid having a particle concentration of from 5,000 to 15,000 pieces/μl;

The number of particles is determined based on a diameter of a circle having a same area as a two-dimensional image photographed by a CCD camera as a circle-equivalent diameter. Based on preciseness of the CCD pixel, the circle-equivalent diameter not less than 0.6 μm is an effective value.

The toner of the present invention can be formed by any methods such as pulverization methods and polymerization methods if the resultant toner satisfy the specification of the present invention. Although the toner produced by the polymerization method has less concavity and convexity on a surface thereof and tends to have poor cleanability, the toner produced thereby having a particle diameter with less unevenness and stable chargeability is used in the present invention.

A modified polyester resin in the present invention includes a polyester resin wherein a group linking with a functional group included in a monomer unit of an acid and alcohol in other manners but an ester linkage is present; and a polyester resin wherein plural resin components having a different structure are linked with each other in a covalent or an electrovalent linkage, etc.

For example, a polyester resin having a functional group such as isocyanate groups reacting with an acid radical and a hydroxyl group at an end thereof wherein the end is further modified or elongated with a compound including an active hydrogen atom is also included. Further, a polyester resin having linked ends with a compound including plural hydrogen atoms such as urea-modified and urethane-modified polyester resins is also included.

In addition, a polyester resin having a reactive group such as double links in a main chain thereof, which is radically polymerized to have a graft component, i.e., a carbon to carbon combination or in which the double links are crosslinked each other such as styrene-modified and acrylic-modified polyester resins is also included.

A polyester resin with a resin having a different composition, which is copolymerized in a main chain thereof or reacted with a carboxyl group and a hydroxyl group at an end thereof, e.g., a polyester resin copolymerized with a silicone resin having an end modified by a carboxyl group, a hydroxyl group, an epoxy group and a mercapto group such as silicone-modified polyester resins is also included. Hereinafter, the modified polyester resin will be more Specifically explained.

Synthesis Example of a Polystyrene-modified Polyester Resin 724 parts of an adduct of bisphenol A with 2 moles of ethyleneoxide, 200 parts isophthalic acid, 70 parts of fumaric acid and 2 parts of dibutyltinoxide are mixed and reacted in a reactor vessel including a cooling pipe, a stirrer and a nitrogen inlet pipe for 8 hrs at a normal pressure and 230° C. Further, after the mixture is depressurized by 10 to 15 mm Hg and reacted for 5 hrs, 32 parts of phthalic acid anhydride are added thereto and reacted for 2 hrs at 160° C. Next, 200 parts of styrene, 1 part of benzoyl peroxide, 0.5 parts of dimethylaniline dissolved in ethyl acetate are reacted with the mixture for 2 hrs at 80° C., and the ethyl acetate is distilled and removed to prepare a polystyrene-graft-modified polyester resin (i) having a weight-average molecular weight of 92,000.

Urea-modified Polyester Resin (i)

Specific examples of the urea-modified polyester resin (i) include reaction products between polyester prepolymers (A) having an isocyanate group and amines (B). The polyester prepolymer (A) is formed from a reaction between polyester having an active hydrogen atom formed by polycondensation between polyol (1) and a polycarboxylic acid (2), and polyisocyanate (3). Specific examples of the groups including the active hydrogen include a hydroxyl group (an alcoholic hydroxyl group and a phenolic hydroxyl group), an amino group, a carboxyl group, a mercapto group, etc. In particular, the alcoholic hydroxyl group is preferably used.

As the polyol (1), diol (1-1) and polyol having 3 valences or more (1-2) can be used, and (1-1) alone or a mixture of (1-1) and a small amount of (1-2) is preferably used.

Specific examples of diol (1-1) include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide.

In particular, alkylene glycol having 2 to 12 carbon atoms and adducts of bisphenol with an alkylene oxide are preferably used, and a mixture thereof is more preferably used.

Specific examples of the and polyol having 3 valences or more (1-2) include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarboxylic acid (2), dicarboxylic acid (2-1) and polycarboxylic acid having 3 or more valences (2-2) can be used. (2-1) alone, or a mixture of (2-1) and a small amount of (2-2) are preferably used.

Specific examples of the dicarboxylic acid (2-1) include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used.

Specific examples of the polycarboxylic acid having 3 or more valences (2-2) include aromatic polycarboxylic acids having 9 to 20 carbon atoms such as trimellitic acid and pyromellitic acid. PC can be formed from a reaction between the PO and the above-mentioned acids anhydride or lower alkyl ester such as methyl ester, ethyl ester and isopropyl ester.

The polyol (1) and polycarboxylic acid (2) are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the polyisocyanate (3) include aliphatic polyisocyanate such as tetramethylenediisocyanate, hexamethylenediisocyanate and 2,6-diisocyanatemethylcaproate; alicyclicpolyisocyanate such as isophoronediisocyanate and cyclohexylmethanediisocyanate; aromatic diisocyanate such as tolylenedisocyanate and diphenylmethanediisocyanate; aroma aliphatic diisocyanate such as α, α, α', α'-tetramethylxylylenediisocyanate; isocyanurate; the above-mentioned polyisocyanate blocked with phenol derivatives, oxime and caprolactam; and their combinations.

The polyisocyanate (3) is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low-temperature fixability of the resultant toner deteriorates. When [NCO] has a molar ratio less than 1, a urea content in ester of the modified polyester decreases and hot offset resistance of the resultant toner deteriorates.

A content of the constitutional component of a polyisocyanate in the polyester prepolymer (A) having a polyisocyanate group at its end portion is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low-temperature fixability of the toner also deteriorate. In contrast, when the content is greater than 40% by weight, low-temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the modified polyester (i) decreases and hot offset resistance of the resultant toner deteriorates.

Specific examples of the amines (B) include diamines (B1), polyamines (B2) having three or more amino groups, amino alcohols (B3), aminomercaptans (B4), amino acids (B5) and blocked amines (B6) in which the amino groups in the amines (B1) to (B5) are blocked.

Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane, diaminocyclohexane and isophorondiamine; aliphatic diamines such as ethylene diamine, tetramethylene diamine and hexamethylene diamine, etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid.

Specific examples of the blocked amines (B6) include ketimine compounds which are prepared by reacting one of the amines (B1) to (B5) with a ketone such as acetone, methyl ethyl ketone and methyl isobutyl ketone; oxazoline compounds, etc. Among these amines (B), diamines (B1) and mixtures in which a diamine is mixed with a small amount of a polyamine (B2) are preferably used.

A molecular weight of the modified polyesters (i) can optionally be controlled using an elongation anticatalyst, if desired. Specific examples of the elongation anticatalyst include monoamines such as diethyle amine, dibutyl amine, butyl amine and lauryl amine, and blocked amines, i.e., ketimine compounds prepared by blocking the monoamines mentioned above. A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the urea-modified polyester (i) decreases, resulting in deterioration of hot offset resistance of the resultant toner. The modified polyester (i) may include an urethane bonding as well as a urea bonding. A molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates. The modified polyester resin (i) of the present invention can be produced by a method such as a one-shot method. The weight-average molecular weight of the modified polyester resin (i) is not less than 10,000, preferably from 20,000 to 10,000,000 and more preferably from 30,000 to 1,000,000. When the weight-average molecular weight is less than 10,000, hot offset resistance of the resultant toner deteriorates. The number-average molecular weight of the modified polyester resin (i) is not particularly limited when the after-mentioned unmodified polyester resin (LL) is used in combination. Namely, the weight-average molecular weight of the modified polyester resin (i) has priority over the number-average molecular weight thereof. However, when the modified polyester resin (i) is used alone, the number-average molecular weight is from 2,000 to 15,000, preferably from 2,000 to 10,000 and more preferably from 2,000 to 8,000. When the number-average molecular weight is greater than 20,000, a low-temperature fixability of the resultant toner deteriorates, and in addition a glossiness of full color images deteriorates.

Unmodified Polyester Resin (LL)

In the present invention, an unmodified polyester resin (LL) can be used in combination with the modified polyester resin (i) as a toner binder resin. It is more preferable to use the unmodified polyester resin (LL) in combination with the modified polyester resin than to use the modified polyester resin alone because a low-temperature fixability and a glossiness of full color images of the resultant toner improve. Specific examples of the unmodified polyester resin (LL) include polycondensated products between the polyol (1) and polycarboxylic acid (2) similarly to the modified polyester resin (i), and products preferably used are the same as those thereof. It is preferable that the modified polyester resin (i) and unmodified polyester resin (LL) are partially soluble each other in terms of the low-temperature fixability and hot offset resistance of the resultant toner. Therefore, the modified polyester resin (i) and unmodified polyester resin (LL) preferably have similar compositions. When the unmodified polyester resin (LL) is used in combination, a weight ratio ((i)/(LL)) between the modified polyester resin (i) and unmodified polyester resin (LL) is from 5/95 to 80/20, preferably from 5/95 to 30/70, more preferably from 5-95 to 25/75, and most preferably from 7/93 to 20/80. When the modified polyester resin (i) has a weight ratio less than 5%, the resultant toner has a poor hot offset resistance, and has a difficulty in having a thermostable preservability and a low-temperature fixability.

The unmodified polyester resin (LL) preferably has a peak molecular weight of from 1,000 to 20,000, preferably from 1,500 to 10,000, and more preferably from 2,000 to 8,000. When less than 1,000, the thermostable preservability of the resultant toner deteriorates. When greater than 10,000, the low-temperature fixability thereof deteriorates. The unmodified polyester resin (LL) preferably has a hydroxyl value not less than 5 mg KOH/g, more preferably of from 10 to 120 mg KOH/g, and most preferably from 20 to 80 mg KOH/g. When less than 5, the resultant toner has a difficulty in having a thermostable preservability and a low-temperature fixability. The unmodified polyester resin (LL) preferably has an acid value of from 10 to 30 mg KOH/g such that the resultant toner tends to be negatively charged and to have better fixability.

In the present invention, the unmodified polyester resin (LL) preferably has a glass transition temperature (Tg) of from 35 to 55° C., and more preferably from 40 to 55° C. The resultant toner can have a thermostable preservability and a low-temperature fixability. A dry toner of the present invention including the unmodified polyester resin (LL) and the modified polyester resin (i) has a better thermostable preservability than known polyester toners even though the glass transition temperature is low.

In the present invention, the toner binder resin preferably has a temperature (TG') not less than 100° C., and more preferably of from 110 to 200° C. at which a storage modulus of the toner binder resin is 10,000 dyne/cm$^2$ at a measuring frequency of 20 Hz. When less than 100° C., the hot offset resistance of the resultant toner deteriorates. The toner binder resin preferably has a temperature (Tη) not greater than 180° C., and more preferably of from 90 to 160° C. at which a viscosity is 1,000 poise. When greater than 180° C., the low-temperature fixability of the resultant toner deteriorates. Namely, TG' is preferably higher than Tη in terms of the low-temperature fixability and hot offset resistance of the resultant toner. In other words, a difference between TG' and Tη (TG'−Tη) is preferably not less than 0° C., more preferably not less than 10° C., and furthermore preferably not less than 20° C. A maximum of the difference is not particularly limited. In terms of the thermostable preservability and low-temperature fixability of the resultant toner, the difference between TG' and Tη (TG'−Tη) is preferably from 0 to 20° C., more preferably from 10 to 90° C., and most preferably from 20 to 80° C.

Specific examples of the colorants for use in the present invention include any known dyes and pigments such as carbon black, Nigrosinedyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red ironoxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. A content of the colorant in the toner is preferably from 1 to 15% by weight, and more preferably from 3 to 10% by weight, based on total weight of the toner.

The colorant for use in the present invention can be used as a master batch pigment when combined with a resin.

Specific examples of the resin for use in the master batch pigment or for use in combination with master batch pigment include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylatecopolymers, styrene-butylmethacrylatecopolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed can be preferably used because the resultant wet cake of the colorant can be used as it is. Of course, a dry powder which is prepared by drying the wet cake can also be used as a colorant. In this case, a three roll mill is preferably used for kneading the mixture upon application of high shear stress.

The present inventors discovered a toner in which a wax having a proper particle diameter is uniformly dispersed and a method of producing the toner. In an O/W type emulsion, a hydrophobic wax is driven by surrounding water to a hydrophobic binder resin, and further penetrates in the hydrophobic binder resin is dissolved and soft. However, it is preferable not to increase the penetration speed, i.e., not to use a solvent having such a high solubility or not to heat the wax at such a high temperature. Consequently, the penetration through the toner binder having a difference of the number of polar group site has a kind of gradient in the direction of depth. In addition, a combined portion of the polar group in the binder (particularly, the modified polyester) has a negative adsorption at an interface with the wax to uniformly disperse a wax having a low polarity. Further, particularly in a method of producing a toner by dissolving or dispersing toner constituents and dispersing the mixture in an aqueous medium, when a wax is left for 30 to 120 min at 35 to 45° C., although a combined portion having a high polarity of the wax is selectively transported to a vicinity of a surface of the toner because of having a slight affinity with water, revealing of the wax particle on the surface thereof is prevented.

When a concentration of the wax in a vicinity of the surface of the toner is larger than that of the wax in the center of the toner, the wax can sufficiently exude when the toner is fixed, and so to speak, an oilless fixation which does not need an oil fixation of particularly a glossy color toner can be performed. On the other hand, when much wax is present in the heart of the toner, the wax has a difficulty in sufficiently exuding when the toner is fixed. The present inventors discovered that the wax present in the toner remains in the toner from an observation of cross-sections of a transfer sheet and the toner. Further, ordinarily, the toner has good durability, stability and preservability because of having less wax on the surface thereof.

When the wax is present by 5 to 40% toward a depth of ⅓ of the radius of a toner, and particularly when not less than 70% by number of the wax is present in the vicinity of the surface of the toner, the toner has better durability, stability and preservability.

When the concentration of the wax in the vicinity of the surface of the toner is smaller than that of the wax in the center of the toner, particularly when the wax is present by less than 5% toward a depth of ⅓ of the radius of atoner, the wax occasionally has a difficulty in exuding on the surface of the toner even if the wax is present much within, and therefore the toner has insufficient hot offset resistance. When the wax is present by greater than 40% toward a depth of ⅓ of the radius thereof, the wax easily exudes on the surface thereof and the toner has insufficient heat resistance and durability.

When not less than 70% by number of the wax is present in the vicinity of the surface of the toner, the wax can exude sufficiently when the toner is fixed and sufficient oilless fixation can be performed.

Not less than 70% by number of the wax preferably has a particle diameter of from 0.1 to 3 μm, and more preferably from 1 to 2 μm. When the number of wax having a particle diameter less than 0.1 μm is large, the wax has a difficulty in exuding on the surface of the toner and the toner cannot have sufficient releasability. When the number of wax having a particle diameter greater than 3 μm is large, the wax easily exudes on the surface of the toner and the toner agglutinates, resulting in deterioration of the fluidity thereof, occurrence of filming, and noticeable deterioration of color reproducibility and glossiness of a color toner.

In the present invention, the particle diameter of the wax is the longest particle diameter of the wax. Specifically, the toner is embedded in an epoxy resin, which is sliced to have a thickness of about 100 μm, and which is dyed with ruthenium tetroxide. A cross-section of the dyed slice is observed by a transmission electron microscope (TEM) at 10,000-fold magnification and 20 images of the toner are photographed to see the dispersion status and measure the particle diameter of the wax.

An occupied area ratio of the wax present in a toner toward a depth of ⅓ of the radius thereof is determined by an area ratio of the presence ratio of the wax present in the toner toward a depth of ⅓ of the radius thereof. The wax which is not present on the surface of the toner but in the vicinity of the surface thereof is the wax present therein toward a depth of ½ of the radius thereof from the surface thereof. (However, the wax present on a point of ½ of the radius is the wax present in the center of the toner.)

In the present invention, although a wax concentration in the vicinity of the toner surface and inside the toner may be measured by known methods, an occupied area ratio of the wax in the vicinity of the toner surface and inside the toner in a cross-section of the toner is measured as a simpler method. In the present invention, the vicinity of the toner surface is a part toward a depth of ½ of the radius of the toner from the toner surface, and the inside of the toner is a part toward a depth of ½ of the radius of the toner from the center thereof.

In the present invention, the toner preferably includes a wax in an amount of from 3 to 10% by weight per 100% by weight of a resin therein. When less than 3%, the toner does not have releasability and hot offset resistance thereof deteriorates. When greater than 10%, the wax melts at a low temperature generated by a mechanical energy and leaves from the surface of the toner when stirred with a carrier in an image developer, and adheres to a surface of the carrier to deteriorate chargeability thereof.

Specific examples of the wax include known waxes, e.g., polyolefin waxes such as polyethylene wax and polypropylene wax; long chain carbon hydrides such as paraffin wax and sasol wax; and waxes including carbonyl groups. Among these waxes, the waxes including carbonyl groups are preferably used. Specific examples thereof include polyesteralkanate such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanate such as ethylenediaminebehenylamide; polyalkylamide such as tristearylamidetrimellitate; and dialkylketone such as distearylketone. Among these waxes including a carbonyl group, polyesteralkanate is preferably used.

The wax for use in the present invention usually has a melting point of from 40 to 160° C., preferably of from 50 to 120° C., and more preferably of from 60 to 90° C. A wax having a melting pointless than 40° C. has an adverse effect on its high temperature preservability, and a wax having a melting point greater than 160° C. tends to cause cold offset of the resultant toner when fixed at a low temperature. In addition, the wax preferably has a melting viscosity of from 5 to 1,000 cps, and more preferably of from 10 to 100 cps when measured at a temperature higher than the melting point by 20° C. A wax having a melting viscosity greater than 1,000 cps makes it difficult to improve hot offset resistance and low temperature fixability of the resultant toner. A content of the wax in a toner is preferably from 0 to 40% by weight, and more preferably from 3 to 30% by weight.

The toner of the present invention may optionally include a charge controlling agent. The charge controlling agent fixed on the toner surface can improve chargeability of the toner.

When the charge controlling agent is fixed on the toner surface, a presence amount and status thereof can be stabilized, and therefore the chargeability of the toner can be stabilized. Particularly, the toner of the present invention has better chargeability when including the charge controlling agent.

Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

Specific examples of the marketed products of the charge controlling agents include BONTRON 03 (Nigrosine dyes), BONTRON P-51 (quaternary ammonium salt), BONTRONS-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

A content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and image density of the toner images.

These charge controlling agent and release agent can be kneaded upon application of heat together with a master batch pigment and a resin, or can be added to toner constituents when dissolved and dispersed in an organic solvent.

Any thermoplastic and thermosetting resins capable of forming an aqueous dispersion can be used as the particulate resin material for use in the present invention. Specific examples of the resins include vinyl resins, polyurethane resins, epoxy resins, polyester resins, polyamide resins, polyimide resins, silicon resins, phenol resins, melamine resins, urea resins, aniline resins, ionomer resins, polycarbonate resins, etc. These can be used alone or in combination. Among these resins, the vinyl resins, polyurethane resins, epoxy resin, polyester resins or combinations of these resins are preferably used because an aqueous dispersion of a fine-spherical particulate resin material can easily be obtained.

Specific examples of the vinyl resins include single-polymerized or copolymerized vinyl monomers such as styrene-ester(metha)acrylate resins, styrene-butadiene copolymers, (metha)acrylic acid-esteracrylate polymers, styrene-acrylonitrile copolymers, styrene-maleic acid anhydride copolymers and styrene-(metha)acrylic acid copolymers. The particulate resin material preferably has an average particle diameter of from 5 to 2,000 nm, and more preferably from 20 to 300 nm.

As an external additive for improving fluidity, developability and chargeability of the colored particles of the present invention, inorganic particles are preferably used. The inorganic particles preferably have a primary particle diameter of from 2 nm to 2 μm, and more preferably from 20 nm to 500 nm. In addition, a specific surface area of the inorganic particles measured by a BET method is preferably from 20 to 500 $m^2/g$. The content of the external additive is preferably from 0.01 to 5% by weight, and more preferably from 0.01 to 2.0% by weight, based on total weight of the toner. Specific examples of the inorganic particles include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Other than these materials, polymer particles such as polystyrene formed by a soap-free emulsifying polymerization, a suspension polymerization or a dispersing polymerization, estermethacrylate or esteracrylate copolymers, silicone resins, benzoguanamine resins, polycondensation particles such as nylon and polymer particles of thermosetting resins can be used.

These external additives, i.e., surface treatment agents can increase hydrophobicity and prevent deterioration of fluidity and chargeability of the resultant toner even in high humidity. Specific examples of the surface treatment agents include silane coupling agents, sililating agents, silane coupling agents having an alkyl fluoride group, organic titanate coupling agents, aluminium coupling agents silicone oils and modified silicone oils.

The toner of the present invention may include a cleanability improver for removing a developer remaining on a photoreceptor and a first transfer medium after transferred. Specific examples of the cleanability improver include fatty acid metallic salts such as zinc stearate, calcium stearate and stearic acid; and polymer particles prepared by a soap-free emulsifying polymerization method such as polymethylmethacrylate particles and polystyrene particles. The polymer particles comparatively have a narrow particle diameter distribution and preferably have a volume-average particle diameter of from 0.01 to 1 μm.

The toner binder of the present invention can be prepared, for example, by the following method. Polyol (1) and polycarboxylic acid (2) are heated at a temperature of from 150 to 280° C. in the presence of a known catalyst such as tetrabutoxy titanate and dibutyltinoxide. Then water generated is removed, under a reduced pressure if desired, to prepare a polyester resin having a hydroxyl group. Then the polyester resin is reacted with polyisocyanate (3) at a temperature of from 40 to 140° C. to prepare a prepolymer (A) having an isocyanate group. Further, the prepolymer (A) is reacted with an amine (B) at a temperature of from 0 to 140° C., to prepare a modified polyester resin (i).

When polyisocyanate, and A and B are reacted, a solvent can be used if desired. Suitable solvents include solvents which do not react with polyisocyanate (3). Specific examples of such solvents include aromatic solvents such as toluene and xylene; ketones such as acetone, methyl ethyl ketone and methyl isobutyl ketone; esters such as ethyl acetate; amides such as dimethylformamide and dimethylacetoaminde; ethers such as tetrahydrofuran.

When polyester (LL) which does not have a urea bonding is used in combination with the urea-modified polyester, a method similar to a method for preparing a polyester resin having a hydroxyl group is used to prepare the polyester resin (LL) which does not have a urea bonding, and the polyester (LL) which does not have a urea bonding is dissolved and mixed in a solution after a reaction of the modified polyester (i) is completed.

A dry toner is produced by the following method, but the method is not limited thereto.

Toner constituents such as a toner binder resin including the modified polyester resin (i), a charge controlling agent and a pigment are mechanically mixed. This mixing process can be performed with an ordinary mixer such as rotating blades under ordinary conditions, and is not particularly limited.

After the mixing process is completed, the mixture is kneaded upon application of heat by a kneader. The kneader includes axial and biaxial continuous kneaders, and roll-mill batch type kneaders. It is essential to see that the kneading upon application of heat does not cut a molecular chain of the toner binder resin. Specifically, the kneading temperature depends on a softening point of the toner binder resin. When too lower than the softening point, cutting of the molecular chain of the toner binder resin increases. When too higher than the softening point, the toner binder resin is not well dispersed.

After the kneading process is completed, the kneaded mixture is pulverized. The mixture is preferably crushed first, and next pulverized. Methods of crashing the mixture to a collision board and pulverizing the mixture in a narrow gap between a rotor and a stator mechanically rotated are preferably used.

After the pulverizing process is completed, the pulverized mixture is classified in an airstream by a centrifugal force to prepare a toner having a predetermined particle diameter, e.g., an average particle diameter of from 5 to 20 μm.

In addition, to improve the fluidity, preservability, developability and transferability of the toner, the inorganic fine particles such as a hydrophobic silica fine powder as mentioned above is externally added to the toner. A conventional powder mixer can be used to mix the external additive, and the mixer preferably has a jacket and can control an inner temperature thereof. To change a history of a load to the external additive, the external additive may be added to the toner on the way of mixing or gradually added thereto. As a matter of course, the number of revolutions, a rolling speed, a time and a temperature of the mixer may be changed. A large load first and next a small load, or vice versa may be applied to the toner. Specific examples of the mixer include a V-form mixer, a locking mixer, a Loedge Mixer, a Nauter Mixer, a Henshel Mixer, etc.

To ensphere the toner, a method of mechanically ensphering the toner by using a hybridizer or a Mechanofusion after the pulverizing process, a method which is so-called a spray dry method of ensphering the toner by using a spray dryer to remove a solvent after toner materials are dissolved and dispersed in the solvent capable of dissolving a toner binder, and a method of ensphering the toner by heating the toner in an aqueous medium can be used. However, the methods are not limited thereto.

An aqueous medium for use in the present invention includes water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

The toner of the present invention can be prepared by reacting a dispersion formed of the prepolymer (A) having an isocyanate group with (B) or by using the modified polyester (i) previously prepared. As a method of stably preparing a dispersion formed of the urea-modified polyester or the prepolymer (A) in an aqueous medium, a method of including toner constituents such as the modified polyester (i) or the prepolymer (A) into an aqueous medium and dispersing them upon application of shear stress is preferably used.

The prepolymer (A) and other toner constituents such as colorants, master batch pigments, release agents, charge controlling agents, unmodified polyester resins (LL), etc. may be added into an aqueous medium at the same time when the dispersion is prepared. However, it is preferable that the toner constituents are previously mixed and then the mixed toner constituents are added to the aqueous liquid at the same time. In addition, colorants, release agents, charge controlling agents, etc., are not necessarily added to the aqueous dispersion before particles are formed, and may be added thereto after particles are prepared in the aqueous medium. A method of dyeing particles previously formed without a colorant by a known dying method can also be used.

A solid particulate dispersant in the aqueous phase uniformly disperse oilspots therein. The solid particulate dispersant is located on a surface of the oilspot, and the oilspots are uniformly dispersed and an assimilation of among the oil spots is prevented. Therefore, the resultant toner has a sharp particle diameter distribution.

The solid particulate dispersant is preferably an inorganic particulate material having an average particle diameter of from 0.01 to 1 μm, which is difficult to dissolve in water and is solid in the aqueous medium.

Specific examples of the inorganic particulate material include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Further, tricalcium phosphate, calcium carbonate, colloidal titanium oxide, colloidal silica and hydroxyapatite are preferably used. Particularly, the hydroxyapatite which is a basic reaction product between sodium phosphate and calcium chloride is more preferably used.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm) means a particle diameter of particles including a liquid). When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C. When the temperature is relatively high, the modified polyester (i) or prepolymer (A) can easily be dispersed because the dispersion formed thereof has a low viscosity.

A content of the aqueous medium to 100 parts by weight of the toner constituents including the modified polyester (i) or prepolymer (A) is typically from 50 to 2,000 parts by weight, and preferably from 100 to 1,000 parts by weight. When the content is less than 50 parts by weight, the dispersion of the toner constituents in the aqueous medium is not satisfactory, and thereby the resultant mother toner particles do not have a desired particle diameter. In contrast, when the content is greater than 2,000, the production cost increases. A dispersant can preferably be used to prepare a stably dispersed dispersion including particles having a sharp particle diameter distribution.

Specific examples of the dispersants used to emulsify and disperse an oil phase for a liquid including water in which the toner constituents are dispersed include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di (octylaminoethyle)glycin, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium-{omega-fluoroalkanoyl(C6-C8)-N-ethylamino}-1-propane sulfonate, fluoroalkyl(C11-C20) carboxylic acids and their metal salts, perfluoroalkylcarboxylic acids and their metal salts, perfluoroalkyl (C4-C12)sulfonate and their metal salts, perfluorooctanesulfonic acid diethanol amides, N-propyl-N-(2-hydroxyethyl)perfluorooctanesulfone amide, perfluoroalkyl(C6-C10) sulfoneamidepropyltrimethylammonium salts, salts of perfluoroalkyl (C6-C10)-N-ethylsulfonylglycin, monoperfluoroalkyl(C6-C16) ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOPEF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLONS-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic compound dispersants such as tricalcium phosphate, calcium carbonate, titanium oxide, colloidal silica and hydroxyapatite which are hardly insoluble in water can also be used.

Further, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

When a dispersant is used, the dispersant may remain on a surface of the toner particle. However, the dispersant is preferably washed and removed after the elongation and/or crosslinking reaction of the prepolymer with amine.

Further, to decrease viscosity of a dispersion medium including The toner constituents, a solvent which can dissolve the modified polyester (i) or prepolymer (A) can be used because the resultant particles have a sharp particle diameter distribution. The solvent is preferably volatile and has a boiling point lower than 100° C. because of easily removed from the dispersion after the particles are formed. Specific examples of such a solvent include toluene, xylene, benzene, carbon tetrachloride, methylenechloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used.

The addition quantity of such a solvent is from 0 to 300 parts by weight, preferably from 0 to 100, and more preferably from 25 to 70 parts by weight, per 100 parts by weight of the prepolymer (A) used. When such a solvent is used to prepare a particle dispersion, the solvent is removed therefrom under a normal or reduced pressure after the particles are subjected to an elongation reaction and/or a crosslinking reaction of the prepolymer with amine.

The elongation and/or crosslinking reaction time depend on reactivity of an isocyanate structure of the prepolymer (A) and amine (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

To make the toner have a desired shape, prior to a desolvent from the dispersion (reaction) liquid after the elongation and/or crosslinking reaction, the dispersion liquid is put in an apparatus equipped with a homomixer, an Ebara milder and a stirrer applying a shearing stress thereto to deform the toner particles substantially having the shape of a sphere to those having the shape of a spindle. Then, a solvent is removed from the dispersion liquid at a temperature not greater than a glass transition temperature of a binder resin to solidify the toner particles having the desired shape.

The shearing stress can be controlled by a processing time and frequency, a temperature of the dispersion liquid and viscosity, and a concentration of an organic solvent in the particles. Deformation degree of each particle differs according to a surface coverage of resin fine particles over the particle and a reactivity thereof with a compound having an active hydrogen, and therefore the resultant shape thereof differs.

To remove an organic solvent from an emulsified dispersion, a method of gradually raising a temperature of the whole dispersion to completely remove the organic solvent in the droplet by vaporizing can be used. Otherwise, a method of spraying the emulsified dispersion in a dry air, completely removing a water-insoluble organic solvent in the droplet to form toner particles and removing a water dispersant by vaporizing can also be used. As the dry air, an atmospheric air, a nitrogen gas, carbon dioxide gas, a gaseous body in which a combustion gas is heated, and particularly various aerial currents heated to have a temperature not less than a boiling point of a solvent used are typically used. A spray dryer, a belt dryer and a rotary kiln can sufficiently remove the organic solvent in a short time.

It is essential to use a solid particulate dispersant in the aqueous medium such that the toner has a volume contraction of from 10 to 90% to have a proper shape. The volume contraction is determined by the following formula:

$$(1-Vt/Vo)\times 100$$

wherein Vo represents a capacity of an oil (dispersion) phase in which the toner constituents are dispersed before emulsified in the aqueous medium; and Vt represents a volume of the dispersion phase after the toner constituents are emulsified and a volatile matter is removed therefrom. Namely, a property change of the toner constituents is measured before and after emulsified.

Specifically, Vo is determined from a weight and an absolute specific gravity of the oil phase before the emulsification and the toner; and Vt is determined from a volumetric average particle diameter of droplets after emulsified in the aqueous medium and particles from which a volatile matter is removed.

When the volume contraction ratio is out of from 10 to 90%, the shape of a particle becomes amorphous, and the volume contraction ratio is more preferably from 30 to 70%.

When an emulsified dispersion is washed and dried while maintaining a wide particle diameter distribution thereof, the dispersion can be classified to have a desired particle diameter distribution. A cyclone, a decanter, a centrifugal separation, etc. can remove particles in a dispersion liquid. A powder after the dispersion liquid is dried can be classified, but the liquid is preferably classified in terms of efficiency. Unnecessary fine and coarse particles can be recycled to a kneading process to form particles. The fine and coarse particles may be wet when recycled.

A dispersant is preferably removed from a dispersion liquid, and more preferably removed at the same time when the above-mentioned classification is performed.

Heterogeneous particles such as release agent particles, charge controlling particles, fluidizing particles and colorant particles can be mixed with a toner powder after dried. Release of the heterogeneous particles from composite particles can be prevented by giving a mechanical stress to a mixed powder to fix and fuse them on a surface of the composite particles.

Specific methods include a method of applying an impact strength on a mixture with a blade rotating at a high-speed, a method of putting a mixture in a high-speed stream and accelerating the mixture such that particles thereof collide each other or composite particles thereof collide with a collision board, etc. Specific examples of the apparatus include an ONG MILL from Hosokawa Micron Corp., a modified I-type mill having a lower pulverizing air pressure from Nippon Pneumatic Mfg. Co., Ltd., a hybridization system from Nara Machinery Co., Ltd., a Kryptron System from Kawasaki Heavy Industries, Ltd., an automatic mortar, etc.

The toner of the present invention can be used for a two-component developer in which the toner is mixed with a magnetic carrier. A content of the toner is preferably from 1 to 10 parts by weight per 100 parts by weight of the carrier.

Suitable carriers for use in the two component developer include known carrier materials such as iron powders, ferrite powders, magnetite powders, magnetic resin carriers, which have a particle diameter of from about 20 to about 200 μm.

The carrier may be coated by a resin. Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

An electroconductive powder may optionally be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic or non-magnetic developer without a carrier.

Amorphous silicon photoreceptors (hereinafter referred to as an a-Si photoreceptors) can be used in the present invention, which is formed by heating an electroconductive substrate at from 50 to 400° C. and forming an a-Si photosensitive layer on the substrate by a vacuum deposition method, a sputtering method, an ion plating method, a heat CVD method, a photo CVD method, a plasma CVD method, etc. Particularly, the plasma CVD method is preferably used, which forms an a-Si layer on the substrate by decomposing a gas material with a DC, a high-frequency or a microwave glow discharge.

FIGS. 3A to 3D are a schematic views illustrating a photosensitive layer composition of the amorphous photoreceptor for use in the present invention respectively.

Figure 3A:
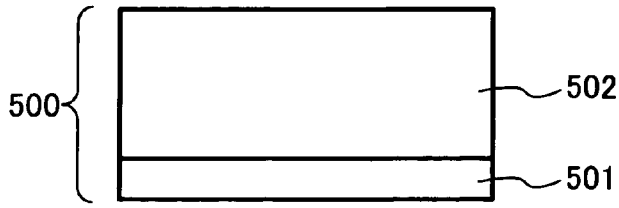
FIGS. 3A to 3D are schematic views illustrating a photosensitive layer composition of the photoreceptor for use in the present invention respectively.
Figure 3B:
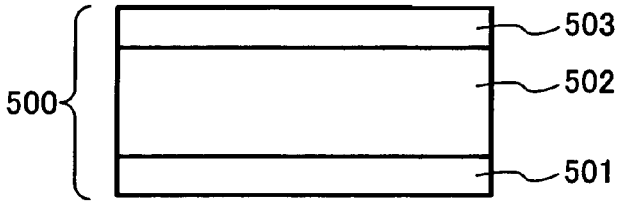

An electrophotographic photoreceptor 500 in FIG. 3A includes a substrate 501 and a photosensitive layer 502 thereon, which is photoconductive and formed of a-Si. An electrophotographic photoreceptor 500 in FIG. 3B includes a substrate 501, a photosensitive layer 502 thereon and an a-Si surface layer 503 on the photosensitive layer 502. An electrophotographic photoreceptor 500 in FIG. 3C includes a substrate 501, a charge injection prevention layer 504 thereon, a photosensitive layer 502 on the charge injection prevention layer 504 and an a-Si surface layer 503 on the photosensitive layer 502. An electrophotographic photoreceptor 500 in FIG. 3D includes a substrate 501, a photosensitive layer thereon including a charge generation layer 505 and a charge transport layer 506 formed of a-Si, and an a-Si surface layer 503 on the photosensitive layer.

The substrate of the photoreceptor may either be electroconductive or insulative. Specific examples of the substrate include metals such as Al, Cr, Mo, Au, In, Nb, Te, V, Ti, Ot, Od and Fe and their alloyed metals such as stainless. In addition, insulative substrates such as films or sheets of synthetic resins such as polyester, polyethylene, polycarbonate, cellulose acetate, polypropylene, polyvinylchloride, polystyrene, polyamide; glasses; and ceramics can be used, provided at least a surface of the substrate a photosensitive layer is formed on is treated to be electroconductive.

The substrate has the shape of a cylinder, a plate or an endless belt having a smooth or a concave-convex surface. The substrate can have a desired thickness, which can be as thin as possible when an electrophotographic photoreceptor including the substrate is required to have flexibility. However, the thickness is typically not less than 10 μm in terms of production and handling conveniences, and a mechanical strength of the electrophotographic photoreceptor.

Figure 3C:
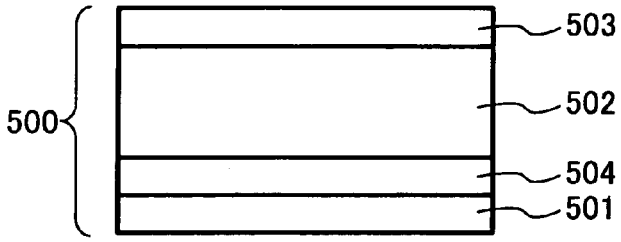
Figure 3D:
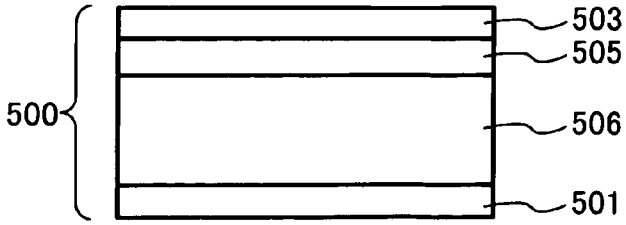

The a-Si photoreceptor of the present invention may optionally include the charge injection prevention layer between the electroconductive substrate and the photosensitive layer in FIG. 3C. When the photosensitive layer is charged with a charge having a certain polarity, the charge injection prevention layer prevents a charge from being injected into the photosensitive layer from the substrate. However, the charge injection prevention layer does not when the photosensitive layer is charged with a charge having a reverse polarity, i.e., has a dependency on the polarity. The charge injection prevention layer includes more atoms controlling conductivity than the photosensitive layer to have such a capability.

The charge injection prevention layer preferably has a thickness of from 0.1 to 5 μm, more preferably from 0.3 to 4 μm, and most preferably from 0.5 to 3 μm in terms of desired electrophotographic properties and economic effects.

The photosensitive layer 502 is formed on an undercoat layer optionally formed on the substrate 501 and has a thickness as desired, and preferably of from 1 to 100 μm, more preferably from 20 to 50 μm, and most preferably from 23 to 45 μm in terms of desired electrophotographic properties and economic effects.

The charge transport layer is a layer transporting a charge when the photosensitive layer is functionally separated. The charge transport layer includes at least a silicon atom, a carbon atom and a fluorine atom, and optionally includes a hydrogen atom and an oxygen atom. Further, the charge transport layer has a photosensitivity, a charge retainability, a charge generation capability and a charge transportability as desired. In the present invention, the charge transport layer preferably includes an oxygen atom.

The charge transport layer has a thickness as desired in terms of electrophotographic properties and economic effects, and preferably of from 5 to 50 μm, more preferably from 10 to 40 μm, and most preferably from 20 to 30 μm.

The charge generation layer is a layer generating a charge when the photosensitive layer is functionally separated. The charge generation layer includes at least a silicon atom, does not include a carbon atom substantially and optionally includes a hydrogen atom. Further, the charge generation layer has a photosensitivity, a charge generation capability and a charge transportability as desired.

The charge transport layer has a thickness as desired in terms of electrophotographic properties and economic effects, and preferably of from 0.5 to 15 μm, more preferably from 1 to 10 μm, and most preferably from 1 to 5 μm.

The a-Si photoreceptor for use in the present invention can optionally includes a surface layer on the photosensitive layer formed on the substrate, which is preferably a a-Si surface layer. The surface layer has a free surface and is formed to attain objects of the present invention in humidity resistance, repeated use resistance, electric pressure resistance, environment resistance and durability of the photoreceptor.

The surface layer preferably has a thickness of from 0.01 to 3 μm, more preferably from 0.05 to 2 μm, and most preferably from 0.1 to 1 μm. When less than 0.01 μm, the surface layer is lost due to abrasion while the photoreceptor is used. When greater than 3 μm, deterioration of the electrophotographic properties such as an increase of residual potential of the photoreceptors occurs.

An image forming apparatus of the present invention comprises a charger configured to charge an electrophotographic photoreceptor to form an electrostatic latent image thereon, an image developer configured to develop the electrostatic latent image with a developer comprising the toner composition of the present invention to form a toner image thereon, a transferer configured to transfer the toner image onto a transfer sheet, a fixer configured to fix the toner image on the transfer sheet, and a cleaner configured to clean the photoreceptor to remove the developer remaining thereon.

An embodiment of the image forming apparatus of the present invention will be explained, referring to FIG. 1.

FIG. 1 is a schematic view illustrating a cross-section of the image forming apparatus of the present invention.

Adjacent to or contacting to a circumference of a photoreceptor drum 1 which is an image bearer, a charging roller 2 uniformly charging the photoreceptor drum 1, an irradiator 3 forming an electrostatic latent image on the photoreceptor drum 1, an image developer 4 developing the electrostatic latent image to form a toner image, a transfer belt 6 transferring the toner image onto a transfer sheet, a cleaner 8 removing a residual toner on the photoreceptor drum 1, a discharge lamp 9 removing a residual charge on the photoreceptor drum 1 and a photodetector 10 controlling a voltage applied to the charging roller and a concentration of the toner are arranged. A toner is fed from a toner feeder which is not shown to the image developer 4 through a toner feeding opening. An image is formed as follows.

The photoreceptor 1 rotates counterclockwise. The photoreceptor 1 is discharged by the discharge lamp 9 and is averaged to have a surface standard potential of from 0 to −150 V. Next, the photoreceptor 1 is charged by the charging roller 2 to have a surface potential of about −1,000 V. Then, the photoreceptor 1 is irradiated by the irradiator 3, and an irradiated (image) part thereof has a surface potential of from 0 to −200 V. The image developer 4 transfers a toner on a sleeve thereof onto the image part to form a toner image on the photoreceptor 1. A transfer sheet is fed from a paper feeder 5 such that an end of the sheet and an end of the toner image meet with each other at the transfer belt 6 while the photoreceptor 1 rotates, and the toner image on the photoreceptor 1 is transferred onto the transfer sheet. Subsequently, the transfer sheet is transferred to a fixer 7, where the toner is fusion bonded on the transfer sheet by a heat and a pressure to discharge a copy image. A residual toner on the photoreceptor 1 is scraped off by the cleaning blade 8 and is recycled (not shown). Then, the photoreceptor 1 is discharged by the discharge lamp 9 again to return to the initial status without the toner and is ready to form another image.

In the present invention, the cleaning blade 8 is preferably an elastic rubber blade contacting the photoreceptor 1 in a counter direction of the rotation direction thereof to effectively remove a paper dust and a toner filming. The elastic rubber blade preferably has a free end in a supporting member thereof, but is not limited thereto. The elastic rubber blade preferably has a hardness of JISA 60 to 70°, a reaction elasticity of 30 to 70%, a Young's modulus of from 30 to 60 kgf/cm$^2$, a thickness of from 1.5 to 3.0 mm, a free length of from 7 to 12 mm, a suppress strength to the photoreceptor not greater than 15 g/cm and a contact angle thereto of from 5 to 50°, and more preferably from 10 to 30°.

Figure 4:
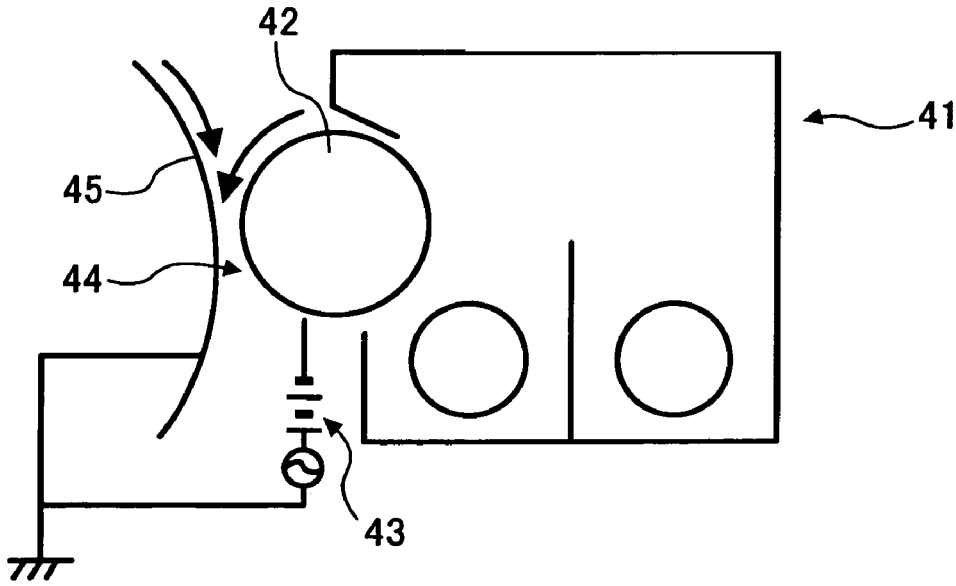
FIG. 4 is a schematic view illustrating an embodiment of an image forming apparatus equipped with the toner container of the present invention.

In a developer container 41 in FIG. 4, a vibration bias voltage which is a DC voltage overlapped with an AC voltage is applied to a developing sleeve 42 from an electric source 43 as a developing bias when developing an image. A background potential and an image potential are located between a maximum and a minimum of the vibration bias potential. An alternate electric field changing the direction alternately is formed at a developing portion 44. In the alternate electric field, a toner and a carrier intensely vibrate, and the toner flies to a photoreceptor drum 45 being released from an electrostatic binding force of the developing sleeve 42 and the carrier and is transferred to a latent image on the photoreceptor drum. In FIG. 4, the image developer applies an alternate current to the electrophotographic photoreceptor.

A difference between the maximum and minimum of the vibration bias voltage (voltage between the peaks) is preferably from 0.5 to 5 KV, and a frequency thereof is preferably from 1 to 10 KHz. The vibration bias voltage can have the waveform of a rectangular wave, a sin curve and a triangular wave. The DC voltage of the vibration bias is a value between the background potential and image potential as mentioned above, and is preferably closer to the background potential than to the image potential to prevent the toner from adhering to the background.

When the vibration bias voltage has the waveform of a rectangular wave, a duty ratio is preferably not greater than 50%. The duty ratio is a time ratio in which the toner is headed for the photoreceptor in one cycle of the vibration bias. A difference between the peak value and time average of the bias orienting the toner to the photoreceptor can be large, and therefore the toner moves more actively and faithfully adheres to the latent image to decrease a roughness and improve image resolution of the toner image. In addition, a difference between the peak value and time average of the bias orienting the carrier to the photoreceptor can be small, and therefore the carrier becomes inactive and probability of the carrier adherence to the background of the latent image can largely be decreased.

Figure 5:
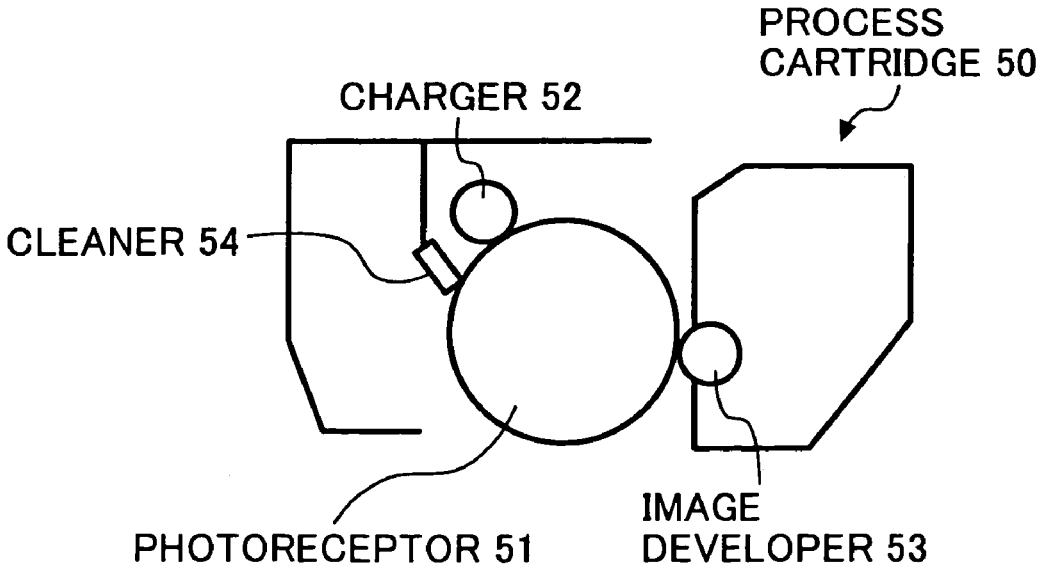
FIG. 5 is a schematic view illustrating an embodiment of the process cartridge of the present invention.

FIG. 5 is a schematic view illustrating an embodiment of the process cartridge of the present invention.

In FIG. 5, numeral 50 is a whole process cartridge, 51 is a photoreceptor, 52 is a charger, 53 is an image developer and 54 is a cleaner.

In the present invention, plurality of the photoreceptor 51, charger 52, image developer 53 and cleaner 54 is combined in a body as a process cartridge. The process cartridge is detachably installed in an image forming apparatus such as a copier and a printer.

In the image forming apparatus having the process cartridge including the toner for developing an electrostatic latent image of the present invention, a photoreceptor rotates at a predetermined peripheral speed. A peripheral surface of the photoreceptor is positively or negatively charged by a charger uniformly while the photoreceptor is rotating to have a predetermined potential. Next, the photoreceptor receives an imagewise light from an irradiator such as a slit irradiator and a laser beam scanner to form an electrostatic latent image on the peripheral surface thereof. Then, the electrostatic latent image is developed by an image developer with a toner to form a toner image. Next, the toner image is transferred onto a transfer material fed to between the photoreceptor and a transferer from a paper feeder in synchronization with the rotation of the photoreceptor. Then, the transfer material which received the toner image is separated from the surface of the photoreceptor and led to an image fixer fixing the toner image on the transfer material to form a copy image which is discharged out of the apparatus. The surface of the photoreceptor is cleaned by a cleaner to remove a residual toner after transfer, and is discharged to repeat forming images.

The fixer comprises a heater, a film contacting the heater, and a pressurizer, wherein the toner image is fixed on the transfer sheet between the film and the pressurizer upon application of heat.

Figure 6:
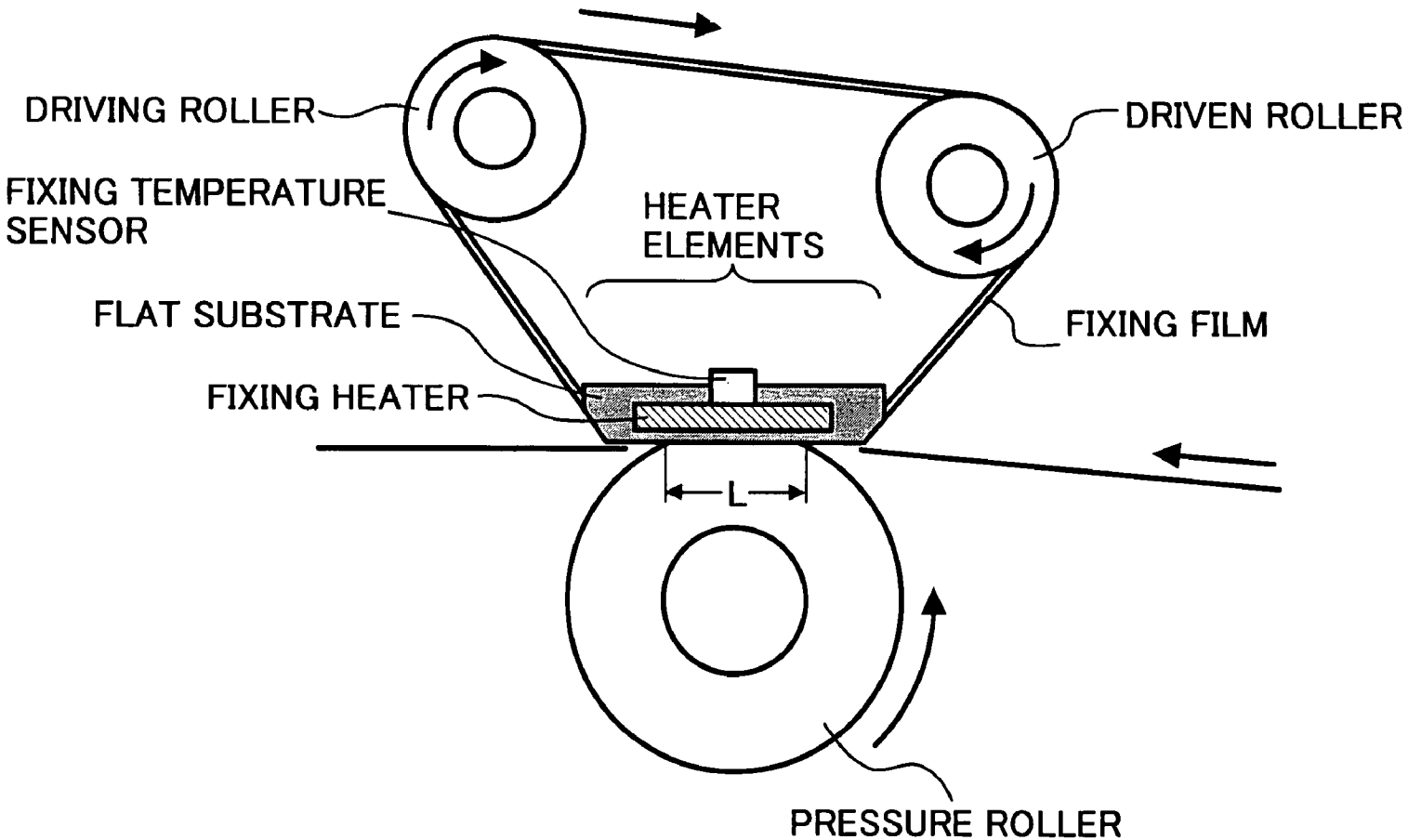
FIG. 6 is a schematic view illustrating a surf fixer rotating a fixing film to fix a toner image in the present invention.
Figure 7:
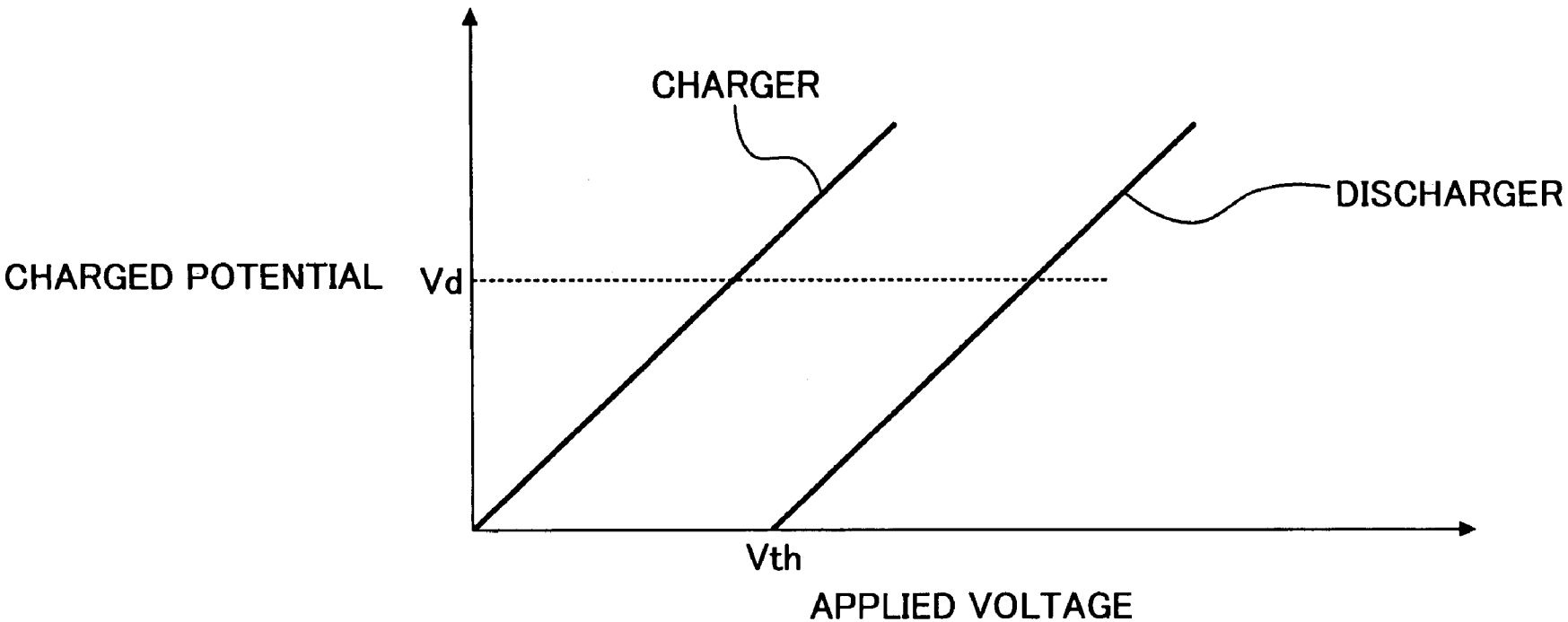
FIG. 7 is a diagram showing charged properties of a photoreceptor charged by a contact charger.

The fixer may be a surf fixer rotating a fixing film as shown in FIG. 6. The fixing film is a heat resistant film having the shape of an endless belt, which is suspended and strained among a driving roller, a driven roller and a heater located therebetween underneath.

The driven roller is a tension roller as well, and the fixing film rotates clockwise according to a clockwise rotation of the driving roller in FIG. 6. The rotational speed of the fixing film is equivalent to that of a transfer material at a fixing nip area L where a pressure roller and the fixing film contact each other.

The pressure roller has a rubber elastic layer having good releasability such as silicone rubbers, and rotates counterclockwise while contacting the fixing nip area L at a total pressure of from 4 to 10 kg.

The fixing film preferably has a good heat resistance, releasability and durability, and has a total thickness not greater than 100 μm, and preferably not greater than 40 μm. Specific examples of the fixing film include films formed of a single-layered or a multi-layered film of heat resistant resins such as polyimide, polyetherimide, polyethersulfide (PES) and a tetrafluoroethyleneperfluoroalkylvinylethe copolymer resin (PFA) having a thickness of 20 μm, on which (contacting an image) a release layer including a fluorocarbon resin such as a tetrafluoroethylene resin (PTFE) and a PFA and an electroconductive material and having a thickness of 10 μm or an elastic layer formed of a rubber such as a fluorocarbon rubber and a silicone rubber is coated.

In FIG. 6, the heater is formed of a flat substrate and a fixing heater, and the flat substrate is formed of a material having a high heat conductivity and a high electric resistance such as alumina. The fixing heater formed of a resistance heater is located on a surface of the heater contacting the fixing film in the longitudinal direction of the heater. A electric resistant material such as Ag/Pd and $Ta_2N$ is linearly or zonally coated on the fixing heater by a screen printing method, etc. Both ends of the fixing heater have electrodes (not shown) and the resistant heater generates a heat when electricity passes though the electrodes. Further, a fixing temperature sensor formed of a thermistor is located on the other side of the substrate opposite to the side on which the fixing heater is located.

Temperature information of the substrate detected by the fixing temperature sensor is transmitted to a controller controlling an electric energy provided to the fixing heater to make the heater have a predetermined temperature.

Figure 8:
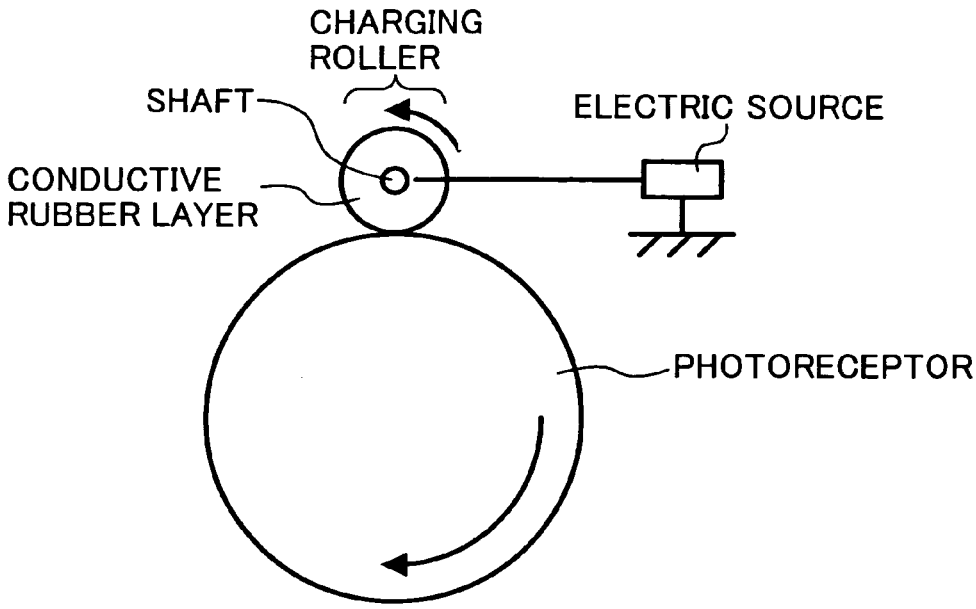
FIG. 8 is a schematic view illustrating an embodiment of the image forming apparatus using a contact charger of the present invention.

FIG. 8 is a schematic view illustrating an embodiment of the image forming apparatus using a contact charger of the present invention. A photoreceptor to be charged and an image bearer rotates at a predetermined speed (process speed) in the direction of an arrow. A roller-shaped charging roller as a charger contacting the photoreceptor is basically formed of a metallic shaft and an electroconductive rubber layer circumferentially and concentrically overlying the metallic shaft. Both ends of the metallic shaft are rotatably supported by a bearing (not shown), etc. and the charging roller is pressed against the photoreceptor by a pressurizer (not shown) at a predetermined pressure. In FIG. 8, the charging roller rotates according to the rotation of the photoreceptor. The charging roller has a diameter of 16 mm because of being formed of a metallic shaft having a diameter of 9 mm and a middle-resistant rubber layer having a resistance of about 100,000 Ω·cm coated on the metallic shaft.

The shaft of the charging roller and an electric source are electrically connected with each other, and the electric source applies a predetermined bias to the charging roller. Accordingly, a peripheral surface of the photoreceptor is uniformly charged to have a predetermined polarity and a potential.

The charger for use in the present invention may have any shapes besides the roller such as magnetic brushes and fur brushes, and is selectable according to a specification or a form of the electrophotographic image forming apparatus. The magnetic brush is formed of various ferrite particles such as Zn—Cu ferrite as a charging member, a non-magnetic electroconductive sleeve supporting the charging member and a magnet roll included by the non-magnetic electroconductive sleeve. The fur brush is a charger formed of a shaft subjected to an electroconductive treatment and a fur subjected to an electroconductive treatment with, e.g., carbon, copper sulfide, metals and metal oxides winding around or adhering to the shaft.

Figure 9:
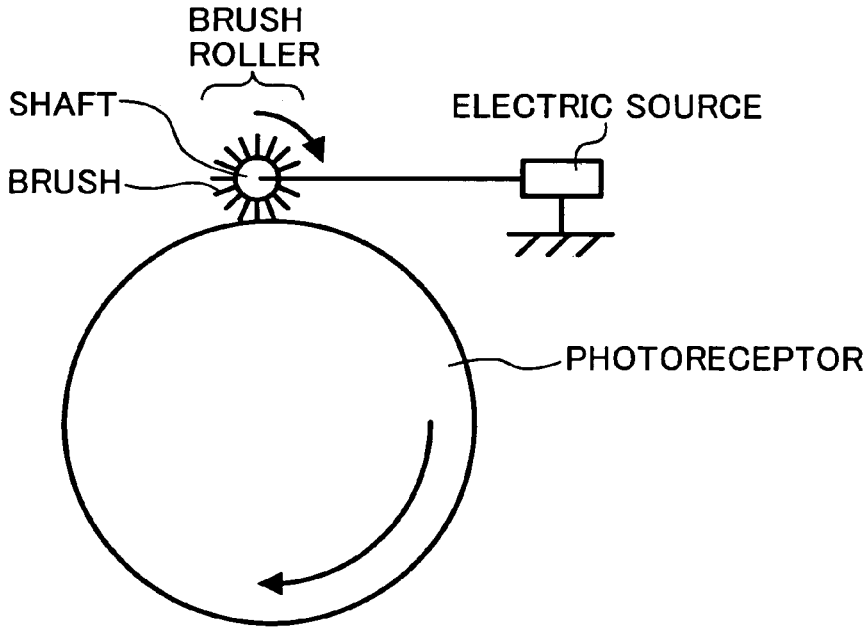
FIG. 9 is a schematic view illustrating another embodiment of the image forming apparatus using a contact charger of the present invention.

FIG. 9 is a schematic view illustrating another embodiment of the image forming apparatus using a contact charger of the present invention. A photoreceptor to be charged and an image bearer rotates at a predetermined speed (process speed)

in the direction of an arrow. A brush roller formed of a fur brush contacts a photoreceptor at a predetermined pressure against an elasticity of the brush and a nip width.

The fur brush roller in this embodiment is a roll brush having an outer diameter of 14 mm and a longitudinal length of 250 mm, which is formed of a metallic shaft having a diameter of 6 mm and being an electrode as well, and a pile fabric tape of an electroconductive rayon fiber REC-B® from Unitika Ltd. spirally winding around the shaft. The brush is 300 denier/50 filament and has a density of 155 fibers/$mm^2$. The roll brush is inserted into a pipe having an inner diameter of 12 mm while rotated in a direction such that the brush and pipe are concentrically located, and is left in an environment of high humidity and high temperature to have inclined furs.

The fur brush roller has a resistance of $1\times10^5$ Ω when an applied voltage is 100 V. The resistance is converted from a current when a voltage of 100 V is applied to the fur brush roller contacting a metallic drum having a diameter of 30 mm at a nip width of 3 mm.

The resistance needs to be not less than $10^4$ Ω and not greater than $10^7$ Ω to prevent defect images due to a insufficiently charged nip when a large amount of leak current flows into a defect such as a pinhole on the photoreceptor, and to sufficiently charge the photoreceptor.

Besides the REC-B® from Unitika Ltd., specific examples of the brush material include REC-C®, REC-M1® and REC-M10® therefrom; SA-7® from Toray Industries, Inc.; Thunderon® from Nihon Sanmo Dyeing Co., Ltd.; Belltron® from Kanebo, Ltd.; Clacarbo® from Kuraray Co., Ltd.; carbon-dispersed rayon; and Roval® from MITSUBISHI RAYON CO., LTD. The brush preferably has a denier of from 3 to 10/fiber, a filament of from 10 to 100/batch and a density of from 80 to 600 fibers/mm. The fiber preferably has a length of from 1 to 10 mm.

The fur brush roller rotates in a counter direction of the rotation direction of the photoreceptor at a predetermined peripheral speed (surface speed) and contact the surface of the photoreceptor at a different speed. A predetermined charging voltage is applied to the fur brush roller from an electric source to uniformly charge the surface of the photoreceptor to have a predetermined polarity and a potential. In this embodiment, the fur brush roller contacts the photoreceptor to charge the photoreceptor, which is dominantly a direct injection charge, and the surface of the photoreceptor is charged to have a potential almost equal to an applied charging voltage to the fur brush roller.

The charger for use in the present invention may have any shapes besides the fur brush roller such as charging rollers and fur brushes, and is selectable according to a specification or a form of the electrophotographic image forming apparatus. The charging roller is typically formed of metallic shaft coated with a middle-resistant rubber layer having a resistance of about 100,000 Ω·cm. The magnetic brush is formed of various ferrite particles such as Zn—Cu ferrite as a charging member, a non-magnetic electroconductive sleeve supporting the ferrite particles and a magnet roll included by the non-magnetic electroconductive sleeve.

FIG. 9 is a schematic view illustrating another embodiment of the image forming apparatus using a contact charger of the present invention. A photoreceptor to be charged and an image bearer rotates at a predetermined speed (process speed) in the direction of an arrow. A brush roller formed of a magnetic brush contacts a photoreceptor at a predetermined pressure against an elasticity of the brush and a nip width.

The magnetic brush for use in the present invention as a contact charger includes magnetic particles coated with a middle-resistant resin including a mixture of Zn—Cu ferrite particles having an average particle diameter of 25 and 10 μm and a mixing weight ratio (25 μm/10 μm) of 1/0.05. The contact charger is formed of the coated magnetic particles, a non-magnetic electroconductive sleeve supporting the magnetic particles and a magnet roll included by the non-magnetic electroconductive sleeve. The coated magnetic particles is coated on the sleeve at a coated thickness of 1 mm to form a charging nip having a width of about 5 mm between the sleeve and photoreceptor, and a gap therebetween is about 500 μm. The magnet roll rotates in a counter direction of the rotation direction of the photoreceptor at a speed of twice as fast as a peripheral speed of a surface of the photoreceptor such that a surface of the sleeve frictionizes the surface of the photoreceptor and the magnetic brush uniformly contacts the photoreceptor.

The charger for use in the present invention may have any shapes besides the magnetic brush roller such as charging rollers and fur brushes, and is selectable according to a specification or a form of the electrophotographic image forming apparatus. The charging roller is typically formed of metallic shaft coated with a middle-resistant rubber layer having a resistance of about 100,000 Ω·cm. The fur brush is a charger formed of a shaft subjected to an electroconductive treatment and a fur subjected to an electroconductive treatment with, e.g., carbon, copper sulfide, metals and metal oxides winding around or adhering to the shaft.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Synthesis of Organic Fine Particle Emulsion)

683 parts of water, 11 parts of a sodium salt of an adduct of a sulfuric ester with ethyleneoxide methacrylate (ELEMINOL RS-30® from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was reacted for 5 hrs at 75° C. to prepare an aqueous dispersion a [fine particle dispersion liquid 1] of a vinyl resin (a copolymer of a sodium salt of an adduct of styrene-methacrylate-butylacrylate-sulfuric ester with ethyleneoxide methacrylate). The [fine particle dispersion liquid 1] was measured by LA-920® to find a volume-average particle diameter thereof was 0.10 μm. A part of the [fine particle dispersion liquid 1] was dried to isolate a resin component therefrom. The resin component had a Tg of 57° C.

(Preparation for an Aqueous Phase)

990 parts of water, 80 parts of the [fine particle dispersion liquid 1], 40 parts of an aqueous solution of sodium dodecyldiphenyletherdisulfonate having a concentration of 48.5% (ELEMINOL MON-7® from Sanyo Chemical Industries, Ltd.) and 90 parts of ethyl acetate were mixed and stirred to prepare a lacteous liquid an [aqueous phase 1]

(Synthesis of Low-molecular-weight Polyester)

220 parts of an adduct of bisphenol A with 2 moles of ethyleneoxide, 561 parts of an adduct of bisphenol A with 3 moles of propyleneoxide, 218 parts terephthalic acid, 48 parts of adipic acid and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs, 45 parts of phthalic acid anhydride were added thereto and reacted for 2 hrs at 180° C. and a normal pressure to prepare a [low-molecular-weight polyester 1]. The [low-molecular-weight polyester 1] had a number-average molecular weight of 2,100, a weight-average molecular weight of 6,700, a Tg of 43° C. and an acid value of 25 mgKOH/g.

(Synthesis of Prepolymer)

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs to prepare an [intermediate polyester 1]. The [intermediate polyester 1] had a number-average molecular weight of 2,100, a weight-average molecular weight of 9,500, a Tg of 55° C. and an acid value of 0.5 and a hydroxyl value of 49.

Next, 411 parts of the [intermediate polyester 1], 89 parts of isophoronediisocyanate and 500 parts of ethyl acetate were reacted in a reactor vessel including a cooling pipe, a stirrer and a nitrogen inlet pipe for 5 hrs at 100° C. to prepare a [prepolymer 1]. The [prepolymer 1] includes a free isocyanate in an amount of 1.53% by weight.

(Synthesis of Ketimine)

170 parts of isophorondiamine and 75 parts of methyl ethyl ketone were reacted at 50° C. for 5 hrs in a reaction vessel including a stirrer and a thermometer to prepare a [ketimine compound 1]. The [ketimine compound 1] had an amine value of 418.

(Synthesis of Master Batch)

40 parts of carbon black Mogal L® from Cabot Corporation, 60 parts of a polyester resin RS-801® from Sanyo Chemical Industries, Ltd. having an acid value of 10, a weight-average molecular weight of 20,000 and a Tg of 64° C., and 30 parts of water were pre-dispersed to prepare a mixture which is a water-logged pigment aggregate. The mixture was kneaded by a two-roll mil having a surface temperature of 130° C. for 45 min and pulverized to prepare a [master batch 1] having a diameter of 1 mm.

(Preparation for Oil Phase)

378 parts of the [low-molecular-weight polyester 1], 110 parts of carnauba wax, 22 parts of charge controlling agent (salicylic acid metal complex E-81® from Orient Chemical Industries Co., Ltd.) and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the [master batch 1] and 500 parts of ethyl acetate were added to the mixture and mixed for 1 hr to prepare a [material solution 1].

1,324 parts of the [material solution 1] were transferred into another vessel, and a pigment and a wax thereof were dispersed by a beads mill (Ultra Visco Mill® from Imecs Co., Ltd.) filled with zirconia beads having a diameter of 0.5 mm by 80 volume % on the condition of 3 passes at a liquid feeding speed of 1 kg/hr and a disk peripheral speed of 6 m/sec. Next, 1,324 parts of an ethyl acetate solution of the [low-molecular-weight polyester 1] having a concentration of 65% were added to the material solution 3 and the mixture was milled by the beads mill at one time to prepare a [pigment and wax dispersion liquid 1]. The [pigment and wax dispersion liquid 1] had a concentration of a solid content of 50% when heated at 130° C. for 30 min.

(Emulsification)

648 parts of the [pigment and wax dispersion liquid 1], 154 parts of the [prepolymer 1] and 6.6 parts of the [ketimine compound 1] were mixed in a vessel by a T.K. homomixer® from Tokushu Kika Kogyo Co., Ltd. at 5,000 rpm for 1 min. 1,200 parts of the [aqueous phase 1] were added to the mixture and mixed by the T.K. homomixer® at 13,000 rpm for 20 min to prepare an [emulsified slurry 1].

(Heterogeneity)

1,000 parts of the [emulsified slurry 1] were mixed with an aqueous solution including 1,365 parts of ion-exchanged water and 35 parts of carboxymethylcellulose (CMC DAICEL-1280® from DAICEL CHEMICAL INDUSTRIES, LTD.) dispersed therein, and the mixture was mixed by the T.K. homomixer® at 2,000 rpm for 1 hr to prepare a [heterogeneous slurry 1].

(De-solvent)

The [heterogeneous slurry 1] was put in a vessel including a stirrer and a thermometer, and after a solvent was removed therefrom at 30° C. for 8 hrs, the slurry was aged at 45° C. for 4 hrs to prepare a [dispersion slurry 1].

(Wash and Dry)

After 100 parts of the [dispersion slurry 1] was filtered under reduced pressure, 100 parts of ion-exchanged water were added thereto and mixed by the T.K. homomixer at 12,000 rpm for 10 min, and the mixture was filtered to prepare a filtered cake.

Further, 100 parts of an aqueous solution of 10% sodium hydrate were added to the filtered cake and mixed by the TK-type homomixer at 12,000 rpm for 30 min upon application of supersonic vibration, and the mixture was filtered under reduced pressure. This supersonic alkaline washing was performed again.

Further, 100 parts of 10% hydrochloric acid were added to the filtered cake and mixed by the TK-type homomixer at 12,000 rpm for 10 min, and the mixture was filtered.

Further, 300 parts of ion-exchanged water were added to the filtered cake and mixed by the TK-type homomixer at 12,000 rpm for 10 min, and the mixture was filtered. This operation was repeated again to prepare a [filtered cake 1]. The [filtered cake 1] was dried by an air drier at 45° C. for 48 hrs and sieved by a mesh having an opening of 75 μm to prepare a mother toner 1. A SF-1 of the mother toner 1 and a content ratio of fine particles having a particle diameter not greater than 3 μm therein are shown in Table 1.

[Evaluation Items]

(Cleanability)

While a blank image was passed through the image forming apparatus imagio NEO450® from Ricoh Company, Ltd. in FIG. 1, the apparatus was stopped after a toner image was transferred from the photoreceptor and a residual toner thereon after cleaned was adhered on a Scotch Tape® from Sumitomo 3M Ltd. And transferred onto a white paper. An image density of the white paper was measured by Macbeth reflection densitometer RD514®. Time when a white paper having an image density not less than 0.2 was produced as evaluated as follows:

●: was not produced even after not less than 125,000 images were produced

○: was produced when not less than 100,000 and less than 125,000 images were produced Δ: was produced when not less than 75,000 and less than 100,000 images were produced X: was produced when less than 75,000 images were produced (Image Quality)

Defective transfer and deterioration of image quality (specifically background fouling) were comprehensively evaluated. As for the defective transfer, after 50,000 images were produced by the image forming apparatus imagio NEO450® from Ricoh Company, Ltd., a solid image was produced to visually evaluate. As for the background fouling, after 50,000 images were produced by the image forming apparatus imagio NEO450® from Ricoh Company, Ltd., an image forming process was stopped while a blank image was developed to transfer a developer on a photoreceptor to an adhesive tape before the image was transferred. A difference of image density between the adhesive tape the developer adhered to and a blank adhesive tape was measured by Spectrodensitometer® from X-Rite, Inc. Good image quality was ○ and poor image quality was X.

Examples 2 to 5 and Comparative Examples 1 to 6

The conditions of the heterogeneity and de-solvent were changed, specifically mixing ratios of the ion-exchanged water, an activator and a thickener in the heterogeneity process, a rotation number of the T.K. homomixer, a time and a method of de-solvent are sequentially changed to prepare toners having different shape factors (SF-1). The evaluation results of the toners are shown in Table 1. Each of the toners in Examples and Comparative Examples had a volume-average particle diameter of from 3.0 to 7.0 μm, and toners in Examples 1 to 5 have high shape factors (SF-1). From Table 1, the toners had cleanability not less than ○ and image quality of ○ when the SF-1 (A) and a content (B) of the toner particles having a particle diameter not greater than 3 μm satisfy one of the following relationships:

$$B \leqq 14 \text{ when } 155 < A \leqq 180; \text{ and}$$

$$B \leqq 0.6A - 79 \text{ when } 145 \leqq A \leqq 155$$

Examples 7 to 12 and Comparative Examples 7 to 16

The conditions of the heterogeneity and de-solvent were changed, specifically mixing ratios of the ion-exchanged water, an activator and a thickener in the heterogeneity process, a rotation number of the T.K. homomixer, a time and a method of de-solvent are sequentially changed to prepare mother toners having a different average circularity, a volume-average particle diameter and a content ratio of fine particles having a particle diameter not greater than 3 μm. 0.7 parts of hydrophobic silica was mixed with 100 parts of each mother toner. The evaluation results of the toners are shown in Table 2.

Figure 2:
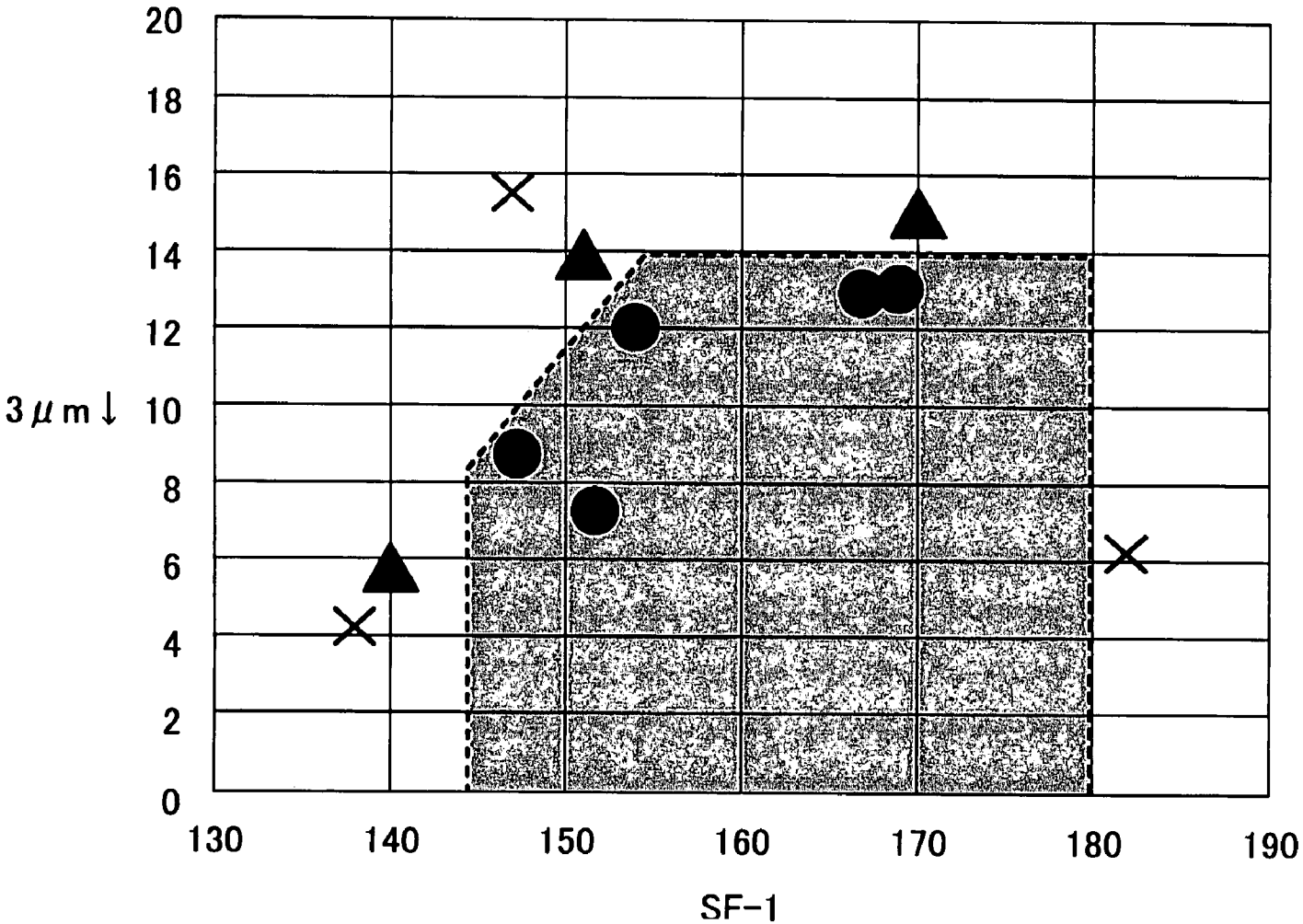
FIG. 2 is a graph showing a relationship of the shape factor SF-1 of the toner of the present invention and the content (%) by number thereof having a particle diameter not greater than 3 μm.
Figure 10:
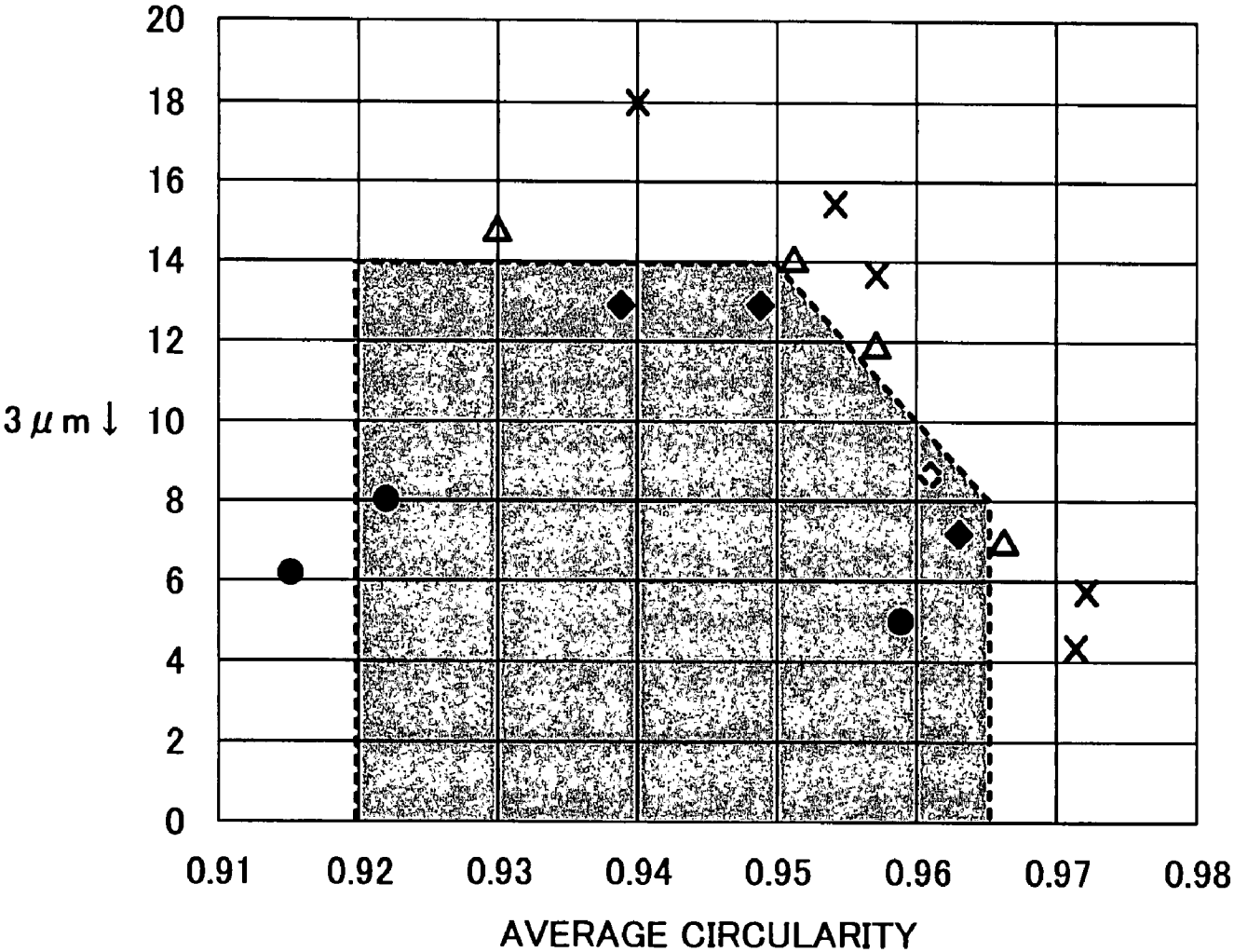
FIG. 10 is a graph showing a relationship of the average sphericity of the toner of the present invention and the content (%) by number thereof having a particle diameter not greater than 3 μm.

A relationship between the SF-1 and the content ratio of fine particles having a particle diameter not greater than 3 μm of each Examples 1 to 5 and Comparative Examples 1 to 6 is shown in FIG. 2, and a relationship between an average circularity and the content ratio of fine particles having a particle diameter not greater than 3 μm of each Examples 1 and 7 to 12 and Comparative Examples 7 to 16 is shown in FIG. 10.

TABLE 1

| | SF-1 | Average circularity | Number % of fine particles having a particle diameter not greater than 3 μm | cleanability | Image quality |
|---|---|---|---|---|---|
| Ex. 1 | 169 | 0.949 | 12.9 | ● | ○ |
| Ex. 2 | 167 | — | 12.9 | ○ | ○ |
| Ex. 3 | 154 | — | 13.6 | ○ | ○ |
| Ex. 4 | 152 | — | 7.23 | ● | ○ |
| Ex. 5 | 148 | — | 8.7 | ○ | ○ |
| Com. Ex. 1 | 147 | — | 15.5 | X | ○ |
| Com. Ex. 2 | 151 | — | 13.8 | Δ | ○ |
| Com. Ex. 3 | 140 | — | 5.8 | Δ | ○ |
| Com. Ex. 4 | 138 | — | 4.31 | X | ○ |
| Com. Ex. 5 | 170 | — | 15.0 | Δ | ○ |
| Com. Ex. 6 | 182 | — | 6.2 | ○ | X |

TABLE 2

| | Average circularity | Number % of fine particles having a particle diameter not greater than 3 μm | Volume-average particle diameter (μm) | Cleanability | Image quality |
|---|---|---|---|---|---|
| Ex. 7 | 0.939 | 12.9 | 4.8 | ● | ○ |
| Ex. 8 | 0.956 | 11.0 | 5.7 | ○ | ○ |
| Ex. 9 | 0.959 | 5.0 | 4.9 | ● | ○ |
| Ex. 10 | 0.961 | 8.7 | 5.6 | ○ | ○ |
| Ex. 11 | 0.963 | 7.2 | 6.1 | ● | ○ |
| Ex. 12 | 0.922 | 8.0 | 7.2 | ● | ○ |
| Com. Ex. 7 | 0.957 | 12.0 | 5.5 | Δ | ○ |
| Com. Ex. 8 | 0.951 | 14.1 | 5.6 | Δ | ○ |
| Com. Ex. 9 | 0.957 | 13.8 | 4.9 | X | ○ |
| Com. Ex. 10 | 0.954 | 15.5 | 6.9 | X | Δ |
| Com. Ex. 11 | 0.966 | 7.2 | 5.5 | Δ | ○ |
| Com. Ex. 12 | 0.972 | 5.8 | 5.7 | X | ○ |
| Com. Ex. 13 | 0.971 | 4.3 | 8.3 | X | X |
| Com. Ex. 14 | 0.915 | 6.2 | 6.3 | ● | X |
| Com. Ex. 15 | 0.940 | 18.0 | 4.6 | X | Δ |
| Com. Ex. 16 | 0.930 | 15.0 | 5.5 | Δ | Δ |

This document claims priority and contains subject matter related to Japanese Patent Applications Nos. 2003-062530, 2003-147202 and 2003-062581, filed on Mar. 7, 2003, May 26, 2003 and Mar. 7, 2003 respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner composition comprising:

toner particles comprising:

binder resin; and colorant, wherein the toner composition satisfies the following relationship (1):

$$12.9 \leqq B \leqq 14 \text{ when } 155 < A \leqq 169; \text{ and}$$

$$7.23 \leqq B \leqq 0.6A - 79 \text{ when } 145 \leqq A \leqq 155, \quad (1)$$

wherein A represents a shape factor SF-1 of the toner composition and B represents a content of toner particles having a particle diameter not greater than 3 μm expressed in % by number.

2. The toner composition of claim 1, further comprising a wax, wherein the wax is dispersed in the toner particles, and wherein a concentration of the wax at a surface of the toner particles is larger than a concentration thereof in a center of the toner particles.

3. The toner composition of claim 1, further comprising a charge controlling agent, wherein the charge controlling agent is fixed on the toner particles.

4. A toner container containing therein the toner composition according to claim 1.

5. A developer comprising the toner composition according to claim 1.

6. An image forming apparatus comprising:

a charger configured to charge an electrophotographic photoreceptor to form an electrostatic latent image thereon;

an image developer configured to develop the electrostatic latent image with a developer to form a toner image thereon, said image developer containing the toner composition of claim 1;

a transferer configured to transfer the toner image onto a transfer sheet;

a fixer configured to fix the toner image on the transfer sheet; and a cleaner configured to clean the photoreceptor to remove the developer remaining thereon.

7. The image forming apparatus of claim 6, wherein the cleaner comprises an elastic rubber blade contacting the electrophotographic photoreceptor in a counter direction of a rotation direction thereof.

8. The image forming apparatus of claim 6, wherein the electrophotographic photoreceptor is an amorphous silicon photoreceptor.

9. The image forming apparatus of claim 6, wherein the fixer comprises:

a heater;

a film contacting the heater; and a pressurizer, wherein the toner image is fixed on the transfer sheet between the film and the pressurizer upon application of heat.

10. The image forming apparatus of claim 6, wherein the charger charges the electrophotographic photoreceptor while contacting the electrophotographic photoreceptor.

11. A process cartridge comprising:

a photoreceptor;

a charger;

an image developer comprising the toner composition according to claim 1; and a cleaner.

12. The toner composition of claim 1, wherein the toner composition has a volume-average particle diameter of from 3.0 to 7.0 μm.

* * * * *